US010875690B2

(12) United States Patent
Robin et al.

(10) Patent No.: US 10,875,690 B2
(45) Date of Patent: Dec. 29, 2020

(54) PLASTIC CAN AND METHOD FOR MANUFACTURING SAME

(71) Applicant: ESTAVAYER LAIT SA, Estavayer-le-Lac (CH)

(72) Inventors: Matthew Robin, Morat (CH); Daniel Gasser, Montbrelloz (CH); Alex Baumgartner, Estavayer-le-Lac (CH); Jerome Mathyer, Chables (CH); Robert Maerky, Winkel (FR); Karine Geillon, St. Germain du Bois (FR); Sebastien Rime, Cesancey (FR)

(73) Assignee: ESTAVAYER LAIT SA, Estavayer-le-Lac (CH)

( * ) Notice: Subject to any disclaimer, the term of this patent is extended or adjusted under 35 U.S.C. 154(b) by 138 days.

(21) Appl. No.: 15/114,887

(22) PCT Filed: Feb. 27, 2015

(86) PCT No.: PCT/IB2015/051470
§ 371 (c)(1),
(2) Date: Jul. 28, 2016

(87) PCT Pub. No.: WO2015/128847
PCT Pub. Date: Sep. 3, 2015

(65) Prior Publication Data

US 2016/0355306 A1 Dec. 8, 2016

(30) Foreign Application Priority Data

Feb. 27, 2014 (EP) ..... 14157082

(51) Int. Cl.
*B65D 51/22* (2006.01)
*B65D 47/08* (2006.01)
(Continued)

(52) U.S. Cl.
CPC ..... *B65D 51/222* (2013.01); *B65B 3/04* (2013.01); *B65B 7/2878* (2013.01); *B65B 55/04* (2013.01);
(Continued)

(58) Field of Classification Search
CPC .... B65D 51/222; B65D 17/165; B65D 1/165; B65D 85/80; B65D 51/226; B65D 51/22;
(Continued)

(56) References Cited

U.S. PATENT DOCUMENTS 2,359,380 A * 10/1944 Ostrom ..... B65D 51/14 215/233
4,371,091 A * 2/1983 Gelina ..... B65D 41/0428 215/329
(Continued)

FOREIGN PATENT DOCUMENTS

EP 0356976 A2 3/1990
EP 0922643 A1 6/1999
(Continued)

OTHER PUBLICATIONS

Guggenheim, Janis. "How long after purchase does apple juice remain safe and tasty to drink?" Jul. 15, 2009. <http://shelflifeadvice.com/content/how-long-after-purchase-does-apple-juice-remain-safe-and-tasty-drink>. Accessed May 3, 2018. (Year: 2009).*
(Continued)

*Primary Examiner* — Ericson M Lachica
(74) *Attorney, Agent, or Firm* — Robert C. Netter, Jr.; Dann, Dorfman, Herrell & Skillman

(57) ABSTRACT

The present invention relates to a can made essentially of plastic and containing a sterile beverage. The can includes a receptacle having a cylindrical body and an upper portion provided with an opening. The opening in the receptacle is hermetically sealed with a closure made of a metal and
(Continued)

plastics composite. A cap comprising a cylindrical side wall and a piercing device is attached to the receptacle. Preferably, the cap comprises a re-closable lid. The receptacle-and-cap assembly have the appearance of a can.

21 Claims, 14 Drawing Sheets

(51) Int. Cl.

| | |
|---|---|
| ***B65D 17/40*** | (2006.01) |
| ***B65D 1/16*** | (2006.01) |
| ***B65D 43/16*** | (2006.01) |
| ***B65D 85/80*** | (2006.01) |
| ***B65B 3/04*** | (2006.01) |
| ***B65B 7/28*** | (2006.01) |
| ***B65B 55/04*** | (2006.01) |
| ***B65B 55/12*** | (2006.01) |
| ***B65D 17/28*** | (2006.01) |

(52) U.S. Cl.
CPC ..... *B65B 55/12* (2013.01); *B65D 1/165* (2013.01); *B65D 17/4012* (2018.01); *B65D 43/16* (2013.01); *B65D 47/0838* (2013.01); *B65D 85/80* (2013.01); *B65D 2251/0025* (2013.01); *B65D 2251/0093* (2013.01); *B65D 2517/0041* (2013.01); *B65D 2517/0082* (2013.01)

(58) Field of Classification Search
CPC ..... B65D 51/20; B65D 43/16; B65D 51/005; B65D 51/14; B65D 51/145; B65D 51/18; B65D 41/00; B65D 41/005; B65D 41/02; B65D 41/026; B65D 41/0428; B65B 3/04; B65B 7/2878; B65B 55/04; B65B 55/12
See application file for complete search history.

(56) References Cited

U.S. PATENT DOCUMENTS

| | | | | |
|---|---|---|---|---|
| 4,840,289 | A * | 6/1989 | Fait | B29C 65/0672 220/270 |
| 5,228,592 | A * | 7/1993 | Pellerano | B65D 47/36 222/83 |
| 5,947,316 | A | 9/1999 | Guillonnet | |
| 6,045,004 | A * | 4/2000 | Elliott | B65D 47/0804 222/494 |
| 6,138,854 | A * | 10/2000 | Kaneko | B65D 17/506 220/254.7 |
| 9,398,822 | B2 | 7/2016 | Wille | |
| 2005/0269337 | A1 | 12/2005 | McGrath | |
| 2005/0269353 | A1* | 12/2005 | Cabelli | B65D 1/0292 222/83 |
| 2009/0139995 | A1* | 6/2009 | Py | A61J 9/00 220/703 |
| 2012/0138621 | A1 | 6/2012 | Bratsch | |
| 2013/0320029 | A1 | 12/2013 | Yourist et al. | |
| 2013/0334224 | A1* | 12/2013 | Kalchmair | B65D 1/0223 220/254.2 |
| 2014/0041338 | A1* | 2/2014 | Zabaleta | B65D 41/32 53/412 |
| 2014/0048549 | A1 | 2/2014 | Wille | |
| 2015/0083724 | A1* | 3/2015 | Lagace | B65D 47/0847 220/258.4 |

FOREIGN PATENT DOCUMENTS

| | | | |
|---|---|---|---|
| WO | 2006/132117 | A1 | 12/2006 |
| WO | 2010/040866 | A1 | 4/2010 |

OTHER PUBLICATIONS

"Safe Handling of Milk and Dairy Products." Mar. 8, 2007. <https://hgic.clemson.edu/factsheet/safe-handling-of-milk-dairy-products/>. Accessed Mar. 6, 2019. (Year: 2007).*

* cited by examiner

PLASTIC CAN AND METHOD FOR MANUFACTURING SAME

TECHNICAL FIELD

The present application is § 371 application of PCT/IB2015/051470, filed Feb. 27, 2015, which claims priority to EP Application No. 14157082.0, filed Feb. 27, 2014. The entire disclosure of each of the foregoing applications is incorporated by reference herein.

STATE OF THE ART AND PROBLEMS FORMING THE BACKGROUND TO THE INVENTION

An object of the present invention is to make available a can that is made of plastic, and preferably such a can that has sterile contents.

Cans for beverages enable them to be consumed, i.e. drunk, conveniently and quickly and are very popular with consumers. They generally contain one or more portions or "serving sizes", such quantities enabling consumers to take cans with them for subsequent drinking, e.g. when they are away or are traveling. Cans are used as containers for alcoholic beverages and for non-alcoholic beverages or "soft drinks", e.g. carbonated beverages, and convey concepts of leisure, pleasure, and freedom.

Cans are generally made of tinplate or aluminum plate. Methods of manufacturing such cans have been developed in such a manner that the contents of the can are at least pasteurized and preferably sterilized following filling, so as to guarantee that the foodstuff is safe. As described in Patent Application EP 2 409 925 A2, such cans have to withstand temperatures in the range of up to 50° C. to 70° C. and internal pressures of up to 7 bars, which is why that document teaches a can in which the enclosed liquid does not come into contact with the plastics material. However, EP 2 409 925 A2 discloses a re-closable lid that can be used on a metal can. Similarly, Patent Applications US 2008/0110887 and DE10244349 disclose re-closable or re-sealable pivotally mounted lids that are made of plastic for cans that are made of metal.

The state of the art also proposes cans made of plastic. For example, Patent Application WO2007/076620 discloses a plastic can that is filled via the portion opposite from the re-closable lid, which is formed in one piece with the body of the can, that can have a rupture point or puncture point that is pushed in by the lid, which can then be folded back to give access to the opening for drinking the beverage.

Document WO 2005/023666 discloses a plastic can made up of two portions, with a receptacle in the form of a bottle, and a re-closable lid. That can appears to be particularly well suited to fizzy beverages, such as, for example, beer.

While the documents of the state of the art indicate the need to pasteurize the beverage enclosed in the can, making a sterile beverage available is not specifically mentioned in the state of the art. Clearly, sterilization requires treatment and conditions that are even more stringent than pasteurization. In addition, sterilization makes it possible to obtain foodstuffs that offer extended shelf-lives, i.e. lengths of time for which they can be eaten or drunk, which is generally desirable. Making a sterile foodstuff available also makes it possible to guarantee that the foodstuff is safe.

An object of the present invention is to provide a plastic can that is preferably a can suitable for containing a sterile and/or sterilized liquid substance.

In particular, an object of the invention is to combine the advantages related to a container of the can type with the advantages of packaging made of plastic. Such plastic packaging can be transparent, if it is so desired. Since manufacturing cans made of metal requires specific installations, it is advantageous to be able to produce a can without such an installation.

In particular, an object of the invention is to make it possible to use pre-existing production, sterilization and/or filling lines, e.g. for filling bottles under aseptic conditions.

SUMMARY OF THE INVENTION

In an aspect, the present invention provides a can made essentially of plastic.

In an aspect, the present invention provides a can made essentially of plastic and containing a liquid foodstuff, and in particular a beverage.

In an aspect, the present invention provides a can made essentially of plastic and containing a sterile liquid foodstuff, and preferably a sterile beverage.

In an aspect, the present invention provides a can made essentially of plastic and containing a pasteurized liquid foodstuff, and preferably a pasteurized beverage.

In an aspect, the present invention provides a can made essentially of plastic and containing a beverage, the can including a receptacle having a substantially cylindrical body and an opening at the top end of the receptacle, said opening being sealed by a closure, the can also including a cap connected to the upper portion of the receptacle and including a piercing device.

In an aspect, the present invention provides a can made essentially of plastic and containing a beverage, the can including a receptacle provided with an opening that is hermetically closed by a closure, said closure being disposed in such a manner as to be opened irreversibly when the can is opened for the first time, said can including a cap placed on an upper portion of the receptacle and including a piercing device adapted to be activated by a consumer to pierce the closure and thus to open the can, said can being characterized in that said cap is secured to the receptacle by at least one bond formed by heat-sealing or welding, said at least one bond being situated between the cap and the upper portion of the receptacle and/or between the cap and the closure.

In an aspect, the present invention provides a cap made of plastic and suitable for being connected to a receptacle in such a manner as to constitute a can, the cap including a piercing device suitable for opening the can and a lid arranged in such a manner as to capable of re-closing said can once said can has been opened.

In an aspect, the present invention provides an (empty) can made of plastic, one or more of its component parts as described, and a can containing a liquid foodstuff.

In an aspect, the present invention provides methods of manufacturing the can of the invention and/or of filling and/or of assembling the can.

In an aspect, the present invention provides methods of packaging the can of the invention and/or of filling and/or of assembling the can.

In an aspect, the invention provides a method of making available and/or of obtaining a can made of plastic and containing a liquid foodstuff, which is preferably a sterile beverage and/or a sterilized beverage.

In an aspect, the invention provides a method of filling a receptacle and/or a plastic can, the filling taking place under aseptic conditions.

In an aspect, the invention provides a method of filling and sealing a plastic can.

In an aspect, the invention provides a method of making available a liquid foodstuff in a can that is made essentially of plastic.

In an aspect, the invention provides a liquid foodstuff packaged in a can that is made essentially of plastic.

In an aspect, the invention provides a method of obtaining and/or of making available a can made of plastic and containing a liquid foodstuff, the method including the steps of: providing a plastic receptacle filled with a liquid foodstuff; closing the filling opening of the receptacle; and attaching a cap to the closed receptacle.

In an aspect, the invention provides a method of obtaining and/or of making available a plastic can containing a liquid foodstuff, the method including the steps of: providing a plastic receptacle filled with a liquid foodstuff and comprising an opening hermetically sealed by a closure; and attaching a cap to the closed receptacle.

In an aspect, the invention provides the plastic can and/or a foodstuff in the plastic can obtained by any one of the methods of the invention.

Other aspects and preferred embodiments of the invention and are defined in the appended claims and in the following description.

DESCRIPTION OF THE DRAWINGS

The characteristics and advantages of the invention appear more clearly on reading the following description of preferred embodiments, the description being given merely by way of non-limiting example, and with reference to the accompanying illustrating drawings, in which:

FIGS. 11 and 12 are perspective views showing the lid being opened for the first time; FIG. 13 is a front view of the cap, with the lid being shown in the closed position, before the lid is opened for the first time;

DETAILED DESCRIPTION OF PREFERRED EMBODIMENTS

Figure 1:
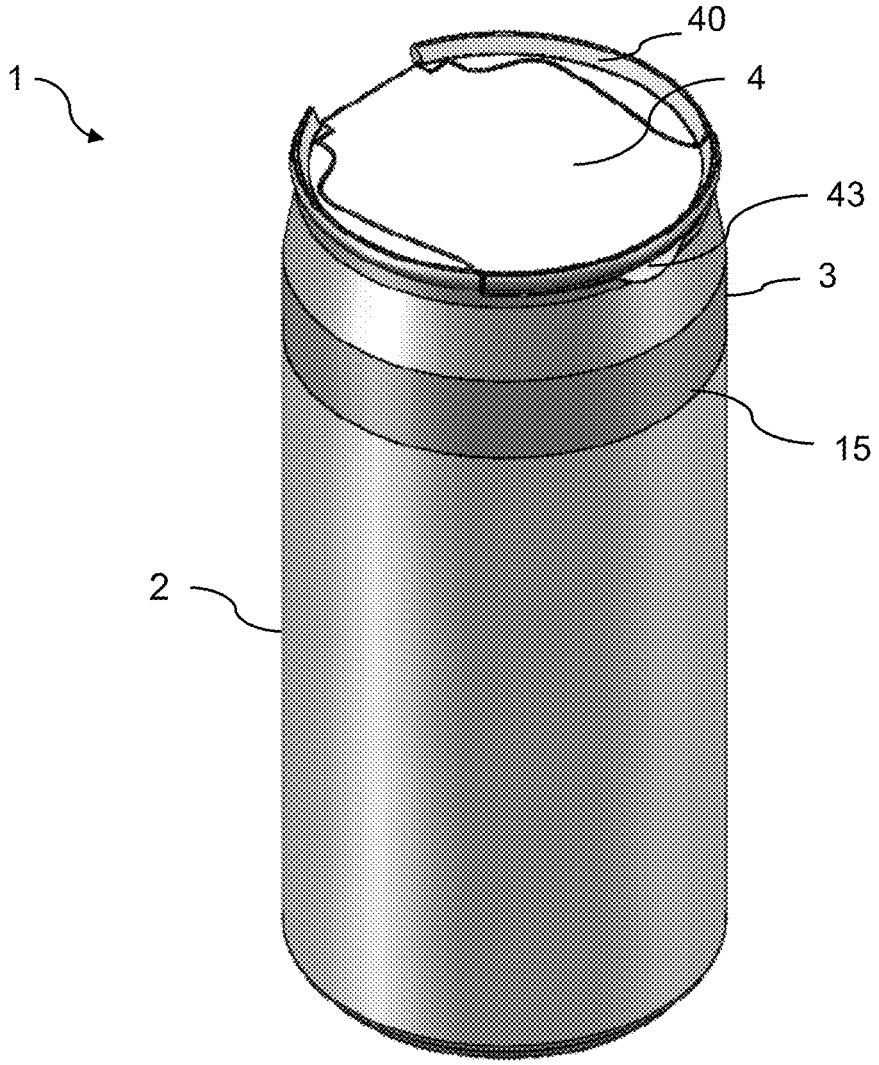
FIG. 1 is a perspective view of an embodiment of a can of the present invention.

FIG. 1 shows a can 1 in accordance with an embodiment of the invention. The can comprises a receptacle 2 and a cap 3. The cap 3 comprises a lid 4. In the embodiment shown, the lid may be opened or closed by pivoting. In a preferred embodiment, the can 1 comprises a re-closable lid 4.

The can 1 is made essentially of plastic, i.e. of a plastics material. In particular, the receptacle 2 is essentially or entirely made of plastic. The cap 3 is preferably essentially or entirely made of plastic. In particular, the beverage (the foodstuff) in the can 1 is in contact with the plastics material of the can 1, and in particular with the plastics material of the receptacle 2.

The plastics material(s) or "plastic(s)" of which the receptacle 2 and the cap 3 of the can of the invention are essentially made is/are preferably constituted by synthetic or artificial polymer material(s). The receptacle 2 and the cap 3 may be formed by thermoforming, plastics injection molding, extrusion blow molding or injection blow molding, for example. In a preferred embodiment, the receptacle 2 is formed by extrusion blow molding. In a preferred embodiment, the cap 3 is formed by plastics injection molding.

The receptacle 2 and/or the cap 3 may be formed of any thermoplastic materials that are usable for manufacturing hollow bodies. Examples of such plastics materials are polyethylene terephthalate (PET), polyethylene (PE), and polypropylene (PP). The receptacle 2 and/or the cap 3 may be made of a "barrier packaging material", e.g. a composite material such as the material described below. The plastics material(s) of which the receptacle 2 and the cap 3 are formed preferably comprise a material or materials that is/are sufficiently rigid to guarantee stability and rigidity for the can 1. Therefore, the receptacle 2 and the cap 3 are preferably of fixed shapes defined by the production method.

In an alternative embodiment, the body 2 of the receptacle, in particular the cylindrical wall 27, includes and/or is made of a soft plastic.

In an embodiment, the receptacle 2 is made of a plurality of layers (it is multilayer), e.g. three or more layers, including a layer that absorbs light, at least partially. In an embodiment, the receptacle includes an anti-oxygen layer, inhibiting diffusion of oxygen through the wall of the receptacle. An anti-oxygen layer may be made of ethylene vinyl alcohol (EVOH). Such a layer is preferably used when the beverage contains vitamins or other substances that can be degraded in the presence of oxygen. The layer that absorbs light and the anti-oxygen layer are barrier layers. Preferably, the receptacle includes or is made entirely of a multilayer configuration and comprises at least one barrier layer, and, for example, includes two or more barrier layers. In an embodiment, the receptacle includes a layer that absorbs light and/or an anti-oxygen layer. The barrier layers are preferably inner layers that are covered by other layers.

In an embodiment, at least a portion of the can is made of transparent plastic. In an embodiment, a portion of or all of the cylindrical side wall 27 (FIG. 3) of the can may be partially or entirely transparent to visible light.

In an embodiment, a portion of or all of the cap 3, e.g. the lid 4, is partially or totally transparent. For example, a portion of the can 1 may include a tinted transparent plastic.

In an embodiment, the can 1 contains a foodstuff, in particular a liquid foodstuff, and preferably a beverage. In a preferred embodiment, the can 1 contains a milk-based foodstuff, e.g. a milk-based beverage. For example, the foodstuff is a yoghurt-based beverage.

The liquid foodstuff may contain flavorings. In an embodiment, the liquid foodstuff contains coffee. For example, the liquid foodstuff may be a coffee with milk, a coffee with steamed milk, a cappuccino, and/or a macchiato coffee. In such cases, the beverage is also a milk-based beverage in the meaning of the invention.

The expression "milk-based foodstuff" or "milk-based beverage" refers to a foodstuff comprising at least one ingredient coming from milk, e.g. including one or more milk proteins, lactose, and/or fat originating from milk.

In a preferred embodiment, a milk-based food comprises milk, e.g. full-cream milk, milk that is totally or partially skimmed, or powder made from full-cream milk or from partially or totally skimmed milk.

In an embodiment, the milk-based foodstuff is allergen-free and/or lactose-free, or contains a substantially reduced quantity of allergens and/or of lactose respectively.

The can of the invention may also contain other beverages. In an embodiment, the can 1 contains a non-milk-based foodstuff, e.g. a non-milk-based beverage.

For example, the liquid foodstuff does not contain any milk. For example, the liquid foodstuff may be a black coffee, a juice, or a carbonated beverage that does not contain any milk or any ingredient coming from milk.

In an embodiment, the foodstuff, in particular the beverage, is homogeneous. For example, when it is a dairy product or a milk-based beverage, the foodstuff is homogenized.

In a preferred embodiment, the can of the invention contains a sterile foodstuff.

In another embodiment, the can of the invention contains a liquid foodstuff that has not been subjected to a sterilization method. For example, in an embodiment, the can of the invention contains a pasteurized liquid foodstuff.

Preferably, the can of the invention contains a liquid foodstuff that can be consumed without any risk for the health of the consumer. The foodstuff may be rendered fit for consumption by any method making it possible to guarantee absence of any risk for health, in particular absence of any harmful microorganisms or sufficiently low presence of such microorganisms to guarantee absence of any risk for health.

In a preferred embodiment, the can of the invention contains a sterile foodstuff, and preferably a sterile beverage. The characteristic of sterility applies to the foodstuff (e.g. said milk-based beverage or said non-milk-based beverage) in the can, after filling and closure, and thus to the volume containing the foodstuff and hermetically sealed as described below. The characteristic of sterility does not necessarily apply to the outside surfaces of the receptacle 2 of the can 1 as a whole.

It should be noted that the term "sterile" refers to an absolute condition, which is absolute absence of any living microorganism. The expression "living microorganism" includes microscopic fungi, including yeast, bacteria, and, in a preferred embodiment, also viruses. In particular, the expression "living microorganism" also includes spores, the resistant forms of certain bacteria and fungi. Preferably, the foodstuff contained in the can of the invention is sterile, any living microorganism being absent from it.

As indicated, the term "sterile" represents an absolute condition: a product is either sterile or is not sterile. Furthermore, the efficacy of a sterilization method cannot be defined in this way, because a population of microorganisms exposed to such a method follows an exponential model. Therefore, there always remains a limited probability that a microorganism might survive the sterilization method, independently of the type or of the length of the method. For this reason, sterility may also be measured as a probability that a microorganism of a population of microorganisms might survive the sterilization method. This probability corresponds to the fraction of the entities (the cans in this example) that are contaminated, and it is known as the "Sterility Assurance Level" (SAL), expressed as a negative exponent. For example, an SAL of $10^{-3}$ indicates a probability of $1/1000^{th}$ that a sterilized entity is contaminated by a living microorganism. The SAL value is the same as the Probability of Non-Sterile Unit (PNSU) value. In this numerical example, one out of 1000 entities might be contaminated. In an embodiment, the foodstuff in the can of the invention has an SAL value of $10^{-1}$ or less, e.g. $10^{-2}$ or less. Preferably, the SAL value is $10^{-3}$ or less, more preferably the SAL value is $10^{-4}$ or less, and even more preferably, it is $10^{-5}$ or less. In a preferred embodiment, the SAL value is $1.5\times10^{-4}$ or less, $2\times10^{-4}$ or less, $3\times10^{-4}$ or less, or indeed $4\times10^{-4}$ or less. In a preferred embodiment, the SAL value is $10^{-6}$ or less. The SAL value of $10^{-6}$ represents the highest standard in certain pharmaceutical fields. An SAL of $10^{-1}$, preferably $10^{-2}$ or possibly $10^{-3}$ or $10^{-4}$ or less has proved to be sufficient in the context of the present invention.

As described below, in an embodiment of the method of the invention for filling and closing the can, the receptacle 2 of the can and the foodstuff are preferably sterilized independently of each other. The closure 10 of the receptacle, described below, is preferably also sterilized. The receptacle 2 is filled and hermetically sealed by a closure under aseptic conditions. In this way, a can containing a sterile foodstuff is obtained.

The sterility makes it possible to present a foodstuff in accordance with the invention and with the foodstuff having a long shelf-life. Shelf-life refers to storage at ambient temperature (25° C.). In an embodiment, the foodstuff in the can of the invention has a shelf-life of at least 2 months (i.e. 2 months or longer), preferably at least 3 months, more preferably at least 4 months, and even more preferably at least 5 months, e.g. at least 6 or 7 months. In an embodiment, the shelf-life of the foodstuff is at least from 3 to 6 months. The above-mentioned shelf-lives apply to a can that contains a beverage and that is hermetically closed by a closure as described in this description. The shelf-life is counted from the date of filling and sealing of the receptacle. Shelf-lives relate to storage before the can is opened for the first time. Once the can is opened, the length of time for which it can be stored can be substantially shorter than the shelf-life, e.g. one day or a few days, at ambient temperature.

In a preferred embodiment, the shelf-life of the foodstuff in the can of the invention is at least six (6) months, e.g. 7, 8, 9, 10, 11, or 12 months, or longer.

Although, in a preferred embodiment, the invention relates to a can containing a sterile liquid foodstuff, said foodstuff is not shown in the figures.

In the embodiments in which the liquid foodstuff is not sterile, e.g. when it is a pasteurized liquid foodstuff, it may have a shorter shelf-life than the shelf-life described above for sterile liquid foodstuffs. In addition, a non-sterile beverage may need to be stored chilled (in the range 1° C. to 5° C.) even before the can is opened for the first time.

Figure 2:
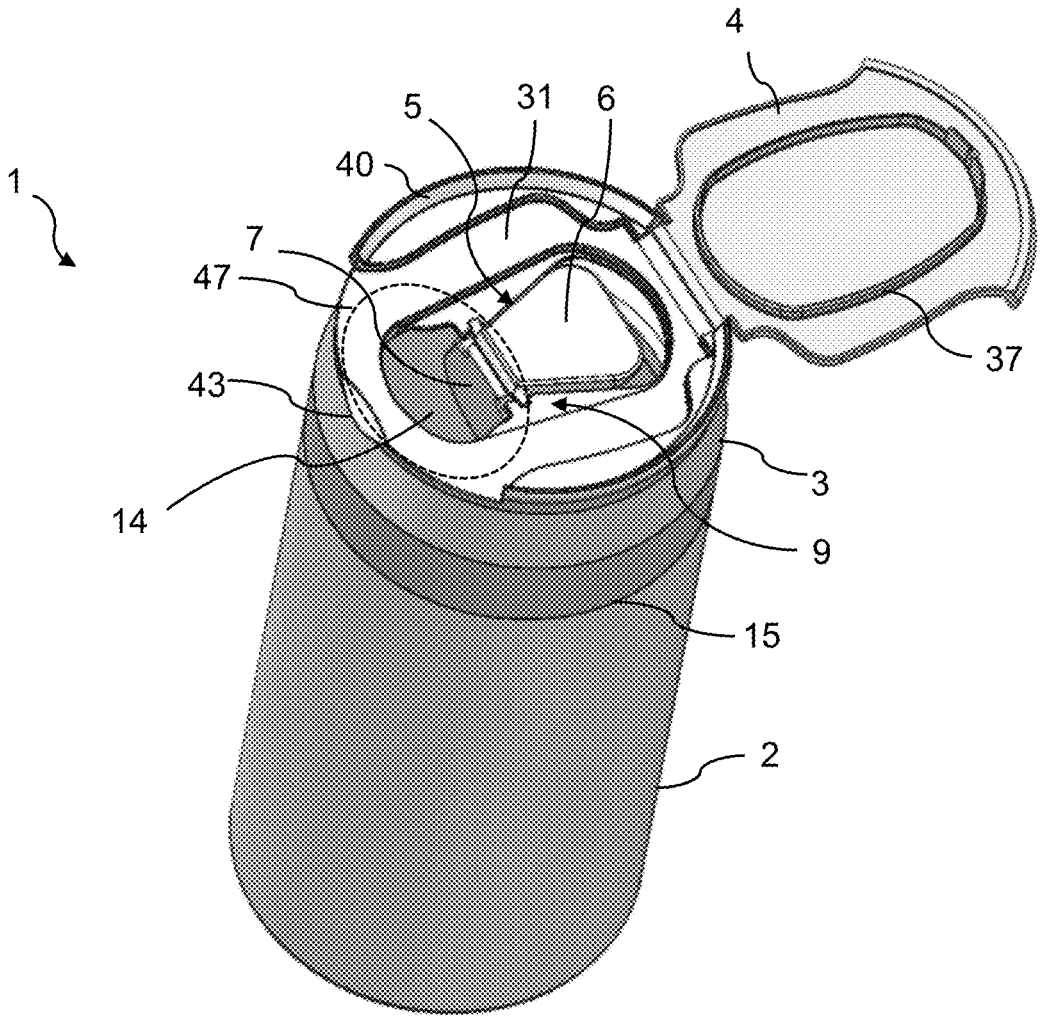
FIG. 2 is a perspective view of the can of FIG. 1, having its lid shown in the open position.

FIG. 2 shows the can 1 in a fully open position. In this position, the lid 4 is pivoted backwards, thereby enabling an observer and consumer respectively to see the piercing device 5 for piercing the can 1, and to manipulate it. As described below with reference to FIG. 4, the piecing device 5 comprises a manipulation member 6 and a piercing structure 7. The member 6 and the piercing structure 7 are structurally connected to each other in such a manner as to enable the closure 10 (FIGS. 6 to 9) to be pierced by actuating the manipulation member. In the embodiment shown in the figures, the manipulation member 6 comprises or is formed by a lever tab 6 and the piercing structure is in the form of a plate 7. The entire piercing device 5 is incorporated in the cap 3. In particular, the piercing device 5 is situated in an opening or closure zone 9 that can be covered and closed by the lid 4.

Figure 9:
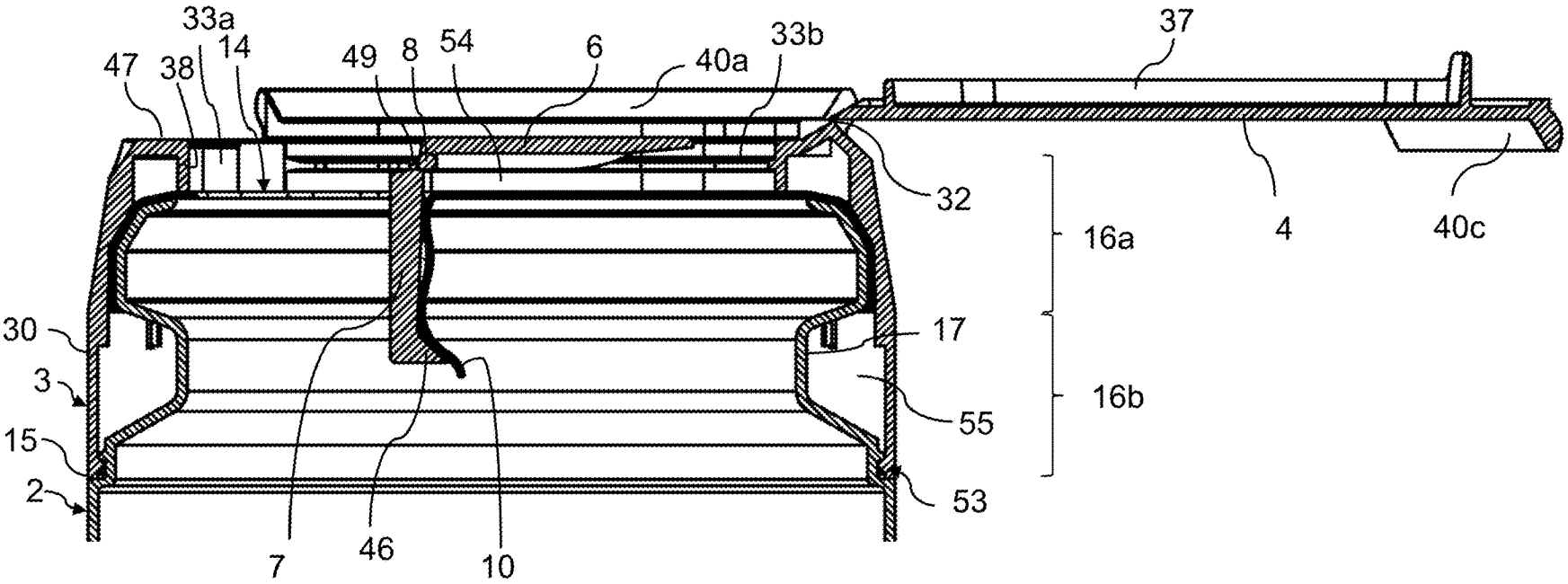
FIG. 9 is the same view as FIG. 8, except that the closure of the can has been pierced.

In FIG. 2, the can 1 is shown not only with the lid 4 in the open position, but also with the piercing structure 7 in the "pierced" position, in this example pivoted downwards. In this position, a drinking or pouring opening 14 is created, the closure 10 having been pierced as shown in FIG. 9.

The elliptical zone in dashed lines referenced 47 in FIG. 2 indicates a zone that is at least partially or potentially in contact with the lips and/or the mouth of a consumer drinking the beverage contained in the can directly from the can. The zone 47 is thus a zone of contact with the mouth of the consumer.

As can be seen by comparing FIGS. 1 and 2, the contact zone 47 is covered by the lid 4 before the can 1 is opened for the first time, and also when the can is re-closed by the lid 4 after it has been opened for the first time. Since the lid 4 is disposed in such a manner as to cover the contact zone 47, the can 1 of the invention offers advantages in terms of hygiene compared with, for example, conventional metal cans. On a metal can, the zone designed to be pierced on opening the can is not covered or otherwise protected. While a conventional can is being manipulated, the contact zone can be touched or exposed to dust or other sources of contaminants. This does not apply with the embodiment of the can shown in the figures, because the lid 4 covers and protects the zone 47 that comes into contact with the mouth of the consumer while the can is being drunk.

Figure 4:
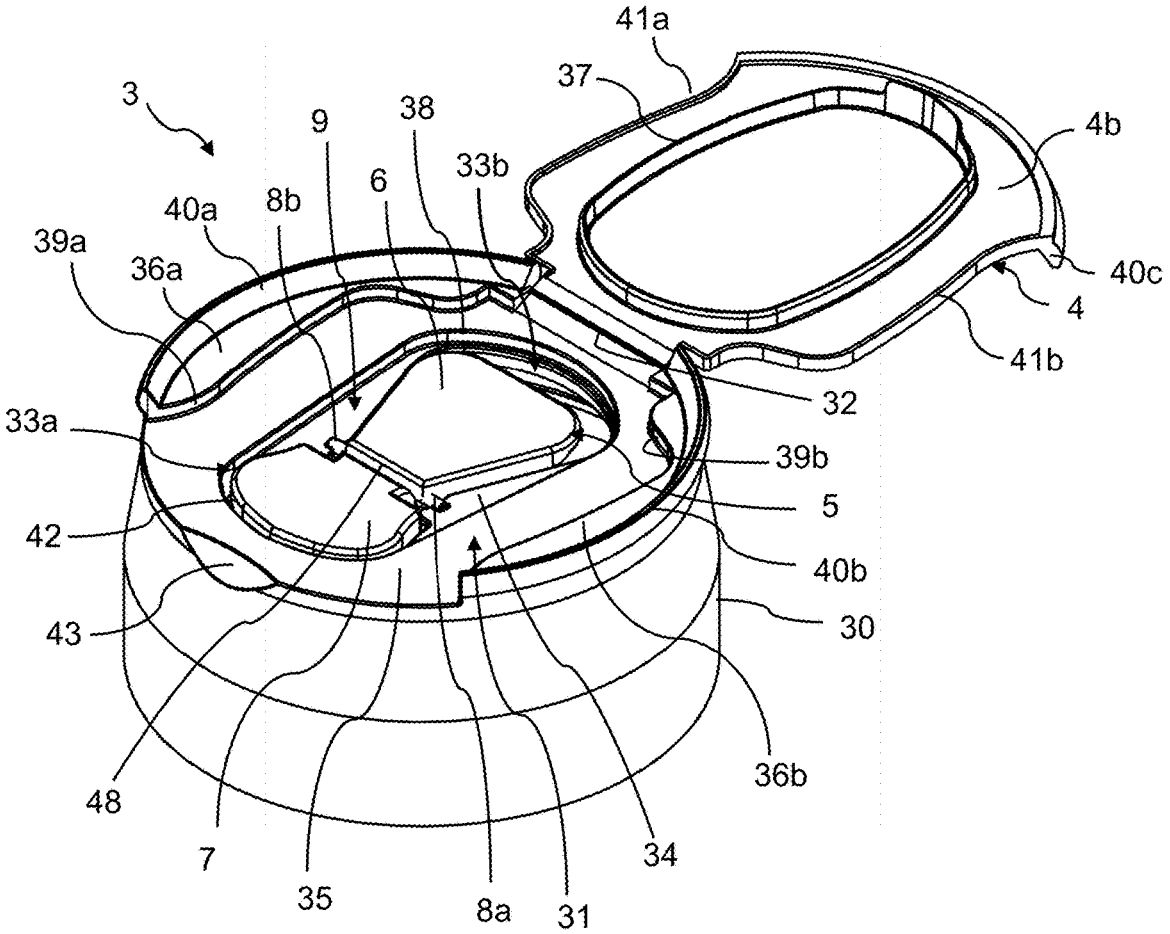
FIG. 4 is a perspective view of the cap of the can shown in FIGS. 1 and 2, with the lid being in the open position.

The lid 4 is preferably adapted to cover a zone that extends beyond (or that is of larger area than) the zone to be covered for the sole purpose of re-closing the drinking opening 14. As can be seen in FIG. 2, the lid 4 covers the closure zone 9 (defined in this example by the wall 38, as shown in FIG. 4), and a zone that surrounds the drinking opening 14. In this example, the entire horizontal level 35 (FIG. 4) is covered by the lid 4. In an embodiment, the lid 4 covers an area of at least 1.0 square centimeters ($cm^2$), preferably of at least 1.4 $cm^2$, and more preferably of at least 1.7 $cm^2$, and even more preferably of at least 2.0 $cm^2$ e.g. of in the range at least 2.0 $cm^2$ to at least 2.5 $cm^2$ of the zone surrounding the drinking opening 14. This area corresponds to at least the area of the surface 4*b* in FIG. 4, so long as it lies outside the wall 37.

In an embodiment, the can of the invention includes a device 5 adapted to generate a drinking opening 14 when the can 1 is opened for the first time by a user, and a contact zone 47 designed to be in contact with the lips and/or the mouth of the consumer while the beverage is being drunk. Preferably, the can 1 comprises a lid 4 covering at least a portion of said contact zone 47 before the can 1 is opened for the first time.

In an embodiment, said contact zone 47 is situated on an outside surface 31 of the can 1 that at least partially surrounds a zone in which said drinking opening is generated when the can is opened for the first time.

In the embodiment shown, the lid 4 covers the entire piercing device 5 in the closed position. The lid 4 covers the entire closure zone 9, in which the piercing device 5, including the lever tab 6 and the piercing plate, is disposed. In an embodiment, the lid 4 is disposed in such a manner as to close at least the drinking opening 14 and the contact zone 47, and preferably also the portion 7 of the piercing device 5 that is pushed into the can when the can is opened for the first time. In another embodiment (not shown), the lid 4 does not cover the lever tab 6.

Regarding the contact zone 47, it should also be said that, in the embodiment shown, the mouth will possibly also be in contact with a portion of the skirt 30 of the cap 3, e.g. at the notch 43 and the zone around the notch 43. The zone over the skirt 30 that could be in contact with the mouth is not covered by the lid 4 (FIG. 1). In the context of the present invention, it is possible to protect this zone by an outside sleeve as described below or indeed by tamper-proofing or tamper-evidencing means, e.g. by a film of plastic that must be torn by the consumer before the can is opened for the first time, said film of plastic being disposed over the skirt 30 in such a manner as to cover the "contact zone" insofar as said contact zone is situated on the skirt 30. In accordance with the invention, the lid 4 covers at least a portion 47 of the entire potential contact zone. For example, the lid 4 covers the area 47 of the outside surface of the can that surrounds the drinking opening 14 of the open can, as shown in FIG. 2. The contact zone 47 is preferably situated on the top horizontal wall 31 of the cap 3. The contact zone 47 preferably covers the entire drinking opening 14 and the outside surface of the can around the opening 14 when the lid 4 is opened. The top horizontal wall 31 is the top wall of the lower portion (the main portion) of the cap 3. This substantially horizontal wall constitutes the main supporting structure of the cap 3. In the embodiment shown in FIGS. 1-2 and 4-9, the top wall 31 faces the lid 4 when said lid is in the closed position.

Figure 3:
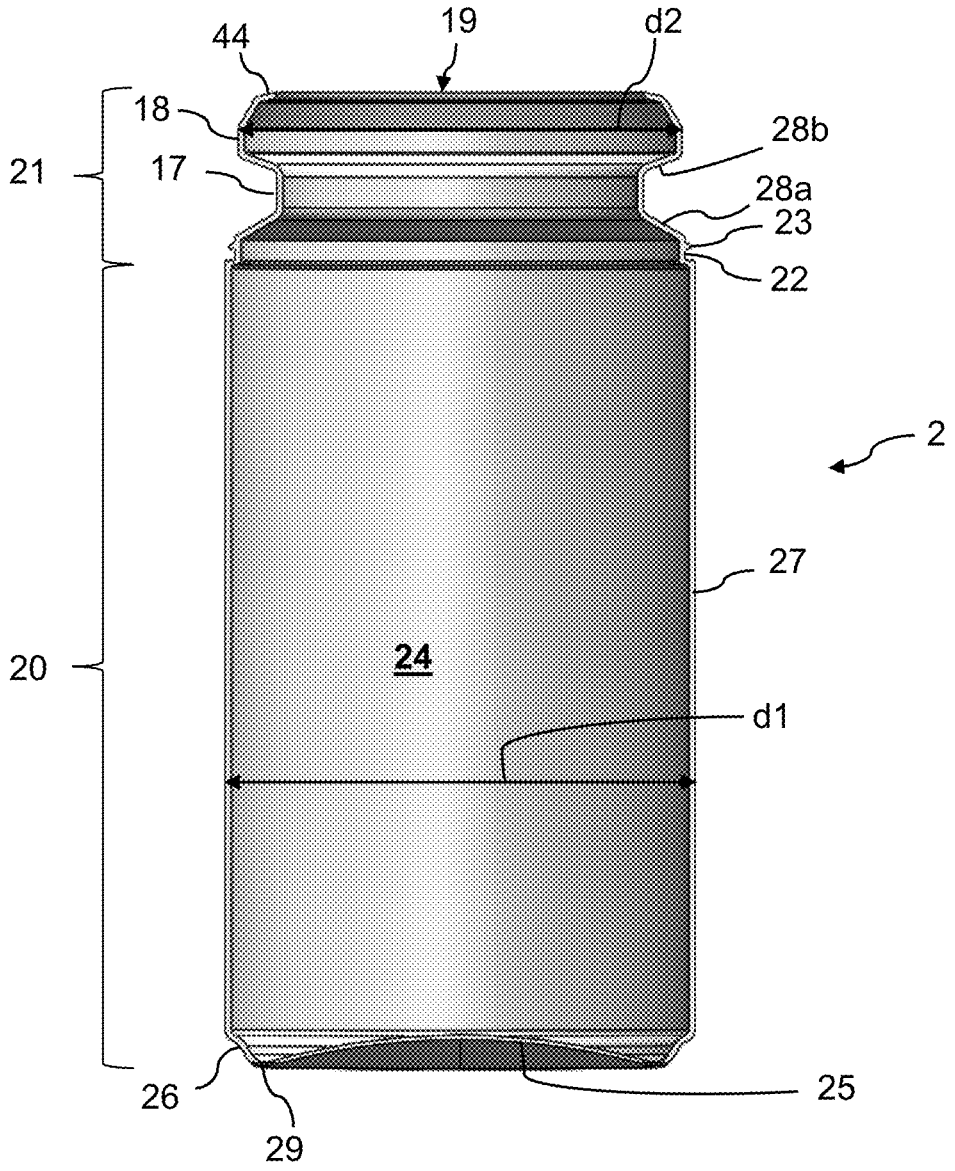
FIG. 3 is a longitudinal section view of the receptacle of the can of FIG. 1.

FIG. 3 shows the receptacle 2 of the can 1. The can 1 comprises at least two different parts, which are separate or separable, namely said receptacle 2 and said cap 3. The two parts 2, 3 are manufactured separately and assembled together and/or connected together after the receptacle has been filled. The closure 10 (FIGS. 6-9) is also a separate part, assembled and/or connected to the receptacle 2 after the receptacle has been filled.

The receptacle 2 comprises a lower portion or "receptacle portion" 20 that mainly defines the volume and the capacity 24 of the can. The lower portion is also referred to as the "body" of the receptacle 2 in the present description. The lower portion 20 has a substantially cylindrical shape, formed by a substantially cylindrical side wall 27. Since the lower portion 20 is visible from the outside, it contributes to the can appearance of the packaging 1 as a whole. The downward end of the lower portion 20 is constituted by the bottom 25 of the receptacle 2 or of the can 1. In the embodiment shown, the bottom 25 is slightly concave and is connected to the cylindrical portion 27 via an edge 29 provided with a peripheral annular setback 26. The bottom thus comprises structures 25, 26, 29 that are complementary to the upper portion of the cap 3, and that are arranged in such a manner as to enable a stack of cans 1 to be formed and/or to be stabilized. The peripheral annular setback 26 has, in particular, a shape that is complementary to the upper rim 40 or to an analogous upper rim 340, 440 in the various embodiments of the cap of the can. The edge 29 may be positioned on the top surface of a lid 4*a*, 404*c*, or on a top surface of the cap in general, and the bottom of the receptacle is then laterally stabilized by the rim 40.

It should be noted that, when the liquid foodstuff contained in the can of the invention is a fizzy and/or carbonated beverage, the bottom of the can generally comprises reinforcing shapes or structures to prevent the can from being deformed. For example, a bottom comprising a star-shaped reinforcement is commonly used for plastics receptacles containing carbonated beverages. The person skilled in the art can alter the receptacle 2 shown in the figures in such a manner as to make it suitable for carbonated beverages.

The person skilled in the art can understand that the side wall 27 of the body 20 may exhibit an outside surface that is otherwise than exactly cylindrical, e.g. that is slightly conical, or that is provided with relief, e.g. when a particular can design is chosen for reasons of pleasing appearance, without going beyond the general concept of the invention. In a preferred embodiment, the lower portion 20 of the receptacle is exactly cylindrical, ignoring the structures 26, 29 forming the transition at the bottom 25 of the can. Such a cylindrical shape contributes to giving the conventional appearance of a metal can.

In a preferred embodiment, the receptacle 2 comprises a lower portion 20 that is not covered by the cap, and said lower portion is essentially cylindrical or comprises at least one cylindrical segment.

The upper portion 21 of the receptacle gives the receptacle 2 as a whole the appearance of a bottle. The upper portion 21 is characterized by the upward end of the cylindrical wall 27. In particular, the cylindrical wall 27 tapers at the upper portion 21, in such a manner as to form a neck 17, before flaring out again to constitute a ring 18. The upper portion 21 thus includes the neck 17 and the ring 18, said ring 18 having an outside diameter greater than the outside diameter of the neck 17. The transition between the cylindrical wall 27 and the neck 17 is formed by a lower collar 28*a*, and the transition between the neck 17 and the ring 18 is formed by an upper collar 28*b*, given that the receptacle 2 as a whole is circularly symmetrical. It is also possible to consider the neck 17 as a peripheral recess that enables the receptacle 2 to be taken hold of and carried by robotized grasping means, e.g. robotized arms. Said robotized means may bear against the receptacle 2 respectively at the lower collar 28*b* or at the upper collar 28*b*, depending on the orientation of the receptacle 2 while it is being manipulated.

In an embodiment, the can 1 of the invention includes a receptacle 2 comprising a substantially cylindrical portion 20 and an upper portion 21 that is narrower than the cylindrical portion 20, the upper portion 21 leading towards an opening 19. Preferably, said receptacle has the general appearance of a bottle.

The opening 19 in the receptacle 2 is situated at the top in FIG. 3. Its size and its shape are defined by the upper edge 44 of the ring 18. The edge 44 is essentially a horizontal annular portion having a top surface that serves as a support on which to bond, i.e. to heat-seal or weld, a closure 10 onto the receptacle 2, as is described below. The opening 19 serves for filling the receptacle with a liquid foodstuff, and for drinking it. The opening 19 is substantially circular. As indicated, the receptacle 2 is circularly symmetrical. The opening 19 is horizontal. Preferably, the opening 19 is centered about the longitudinal axis of circular symmetry of the receptacle.

The can 1 and/or the receptacle 2 is/are preferably filled via the opening 19. In an alternative embodiment, the receptacle is provided with another opening and/or with a separate opening, in particular making filling possible. For example, the invention considers the possibility of filling via the bottom. For example, an opening may be situated at the bottom of the can, e.g. in the bottom 25. Such an alternative embodiment of a can could be filled once the opening 19 has been sealed, or also when the opening 19 is totally absent, e.g. when it is replaced by some other system making piercing possible. For example, the closure 10 of the can as described above may be formed by a rupture line in the material of which the receptacle 2 is made. The invention covers any possibility for an opening enabling the can to be filled at a position other than the position of the opening 19.

The upper portion 21 of the receptacle 2 is provided with a peripheral groove 22. The purpose of this groove 22 is to enable the cap 3 to be connected to the receptacle 2 by snap-fastening. The groove 22 defines a portion of snap-fastening means. The groove 22 is delimited downwards by the cylindrical wall 27 and upwards by a peripheral shoulder 23 that is in the form of an annular projection on the upper portion 21.

In general, the upper portion 21 of the receptacle 2 and the cap 3 preferably comprise complementary shapes that are arranged to make connection by snap-fastening possible.

It should be noted that the lower portion 20 has a diameter d1 that is greater than the maximum diameter over the entire upper portion 21. In other words, at no position does the upper portion have a diameter that exceeds the diameter defined by the outside surface of the cylindrical wall 27 of the body 20. The entire upper portion 21 thus generally has dimensions that are smaller than the dimensions of the outside surface of the cylindrical wall 27, such dimensions being measured along horizontal axes defining the diameter of the receptacle 2 at any given vertical positions. For example, the diameter d2 of the ring 18 (as measured at the outside surface of the ring 18) is less than the diameter d1. In the embodiment shown, the maximum diameter of the upper portion of the receptacle 2 is situated at the level (in the vertical direction) of the annular projection 23.

The widest diameter of the upper portion 21 is preferably smaller than the diameter of the lower portion at the upper end of the lower portion 20, defining the transition 15 between the lower portion and the cap 3. In a preferred embodiment, the largest diameter of the upper portion 21 is smaller than the smallest diameter of the lower portion 20, ignoring the reduction in the diameter at the transition 26, 29 at the bottom 25 of the receptacle.

The smaller horizontal dimensions and/or the smaller diameter of the upper portion 21 make it possible for the cap 3 to mask or to cover said upper portion 21 completely, as can be seen more clearly in FIGS. 1 and 2. These smaller dimensions/diameters make it possible, in particular, to use a cap 3 in which the outside side wall has the same dimension, and in particular the same diameter d1, as the cylindrical side wall 27 of the lower portion 22 of the receptacle. The assembly comprising the receptacle 2 and the cap 3 thus gives the appearance of a cylindrical can 1 as can be seen in FIGS. 1 and 2, while the upper portion of the receptacle 2 is provided with the neck 17 making robotized manipulation possible.

In a preferred embodiment, the cap is arranged on the receptacle in such a manner as to feature an outline that, in profile, is continuous and/or is arranged in such a manner that the outside surfaces of the lower portion 20 of the receptacle and of the lower portion 30 of the cap are flush with each other, together making the assembly comprising the cap 3 and the receptacle 2 look like it is formed in one piece. Preferably, this applies even when the receptacle 2 has a non-cylindrical outside shape over its lower portion 20, e.g. it has a lower portion 20 featuring a profile (longitudinal section) that is curved (not shown).

In a preferred embodiment, the cap comprises a skirt including an essentially cylindrical lower portion in contact with an essentially cylindrical portion or segment of the lower portion of the receptacle, and the cylindrical portion of the cap and the cylindrical segment of the receptacle have the same diameter so that together they exhibit a uniform cylindrical outside appearance.

The outside surface of the can 2 at the transition between the receptacle and the cap extends preferably without any discontinuity and/or without any visible break.

As shown in the perspective view of FIG. 4, on its top face or lid face 31, the cap 3 comprises the lid 4 and the piercing device 5. The piercing device 5 is incorporated into the top wall 31 of the cap 3, and the lid 4 is connected via a hinge 32 to the cap 3. The hinge 32 is a "hinge film" or a "film hinge" formed by a portion of reduced thickness of plastics material that connects the lid 4 to the top wall 31 of the cap 3. As mentioned, the cap 3 as a whole, including the piercing device 5 and the lid 4, is formed in one piece, and preferably by injection molding (plastics injection molding).

The cap 3 includes the side wall or skirt 30, the outside surface of which, visible in FIG. 4, is substantially cylindrical. It should be specified that, as can be seen more clearly in FIG. 9, the outside surface of the side wall 30 comprises a cylindrical lower portion and slightly conical upper portion. The top wall 31, which has a substantially circular outline, is connected via its periphery to the conical upper portion of the peripheral skirt 30. Conversely, at least the cylindrical lower portion of the outside surface of the side wall 30 has the same outside diameter as the cylindrical side wall 27 of the receptacle 2, in such a manner as to form a cylindrical and uniform outside can surface, as can be seen in FIGS. 1 to 6, for example.

In other words, the cap 3 is formed in such a manner as to contribute to the substantially cylindrical can appearance of the can 1, by masking an upper portion 21 of the receptacle 2 that, for example for reasons related to aseptic filling, exhibits an outside surface that looks like a bottle rather than a can.

It should be specified that the person skilled in the art will understand that the peripheral outside wall 30 of the cap 3 could exhibits a substantially cylindrical outside surface, without a conical portion, or it could also be slightly conical overall (without a completely cylindrical portion), without going beyond the general concept of the invention.

The piercing device 5 is situated in a recess or opening 33 that is provided in the top wall 31 of the cap. The recess 33 comprises two recesses, namely a front recess 33*a* and a back recess 33*b*, the recesses 33*a* and 33*b* being separated by the support 34 of the piercing device 5. The recesses 33*a* and 33*b* pass through the top wall 31 of the cap 3, and thus constitute openings through which the foodstuff in the can could pass once the can (and in particular the closure) is open. As becomes clear below, during drinking, the foodstuff passes preferentially through a drinking opening 14 (FIGS. 2 and 9) that takes the place of the recess 33*a* once the can is opened. The back recess 33*b* creates an empty space making it possible for the lever tab 6 of the piercing device 5 to be taken hold of by the tip of a finger, typically the index finger.

The piercing device 5 includes a piercing plate (or striker) 7 and a lever tab 6 connected on either side to a pair of pins 8*a* and 8*b* that form a rotary shaft 8. The piercing plate 7 is disposed in such a manner as to pierce a closure 10 (not shown in FIG. 4) while the lever tab is being manipulated, as described in detail below.

FIG. 4 shows the bottom face 4*b* of the lid 4, on which face the edge or the sealing wall 37 is situated. The edge 37 is a projection that forms a closed loop and that surrounds an area that corresponds to or is slightly smaller than the area surrounded by the wall 38, in order to enable the edge 37 to fit inside the wall 38. For example, the projection 37 is substantially circular or elliptical.

Figure 5:
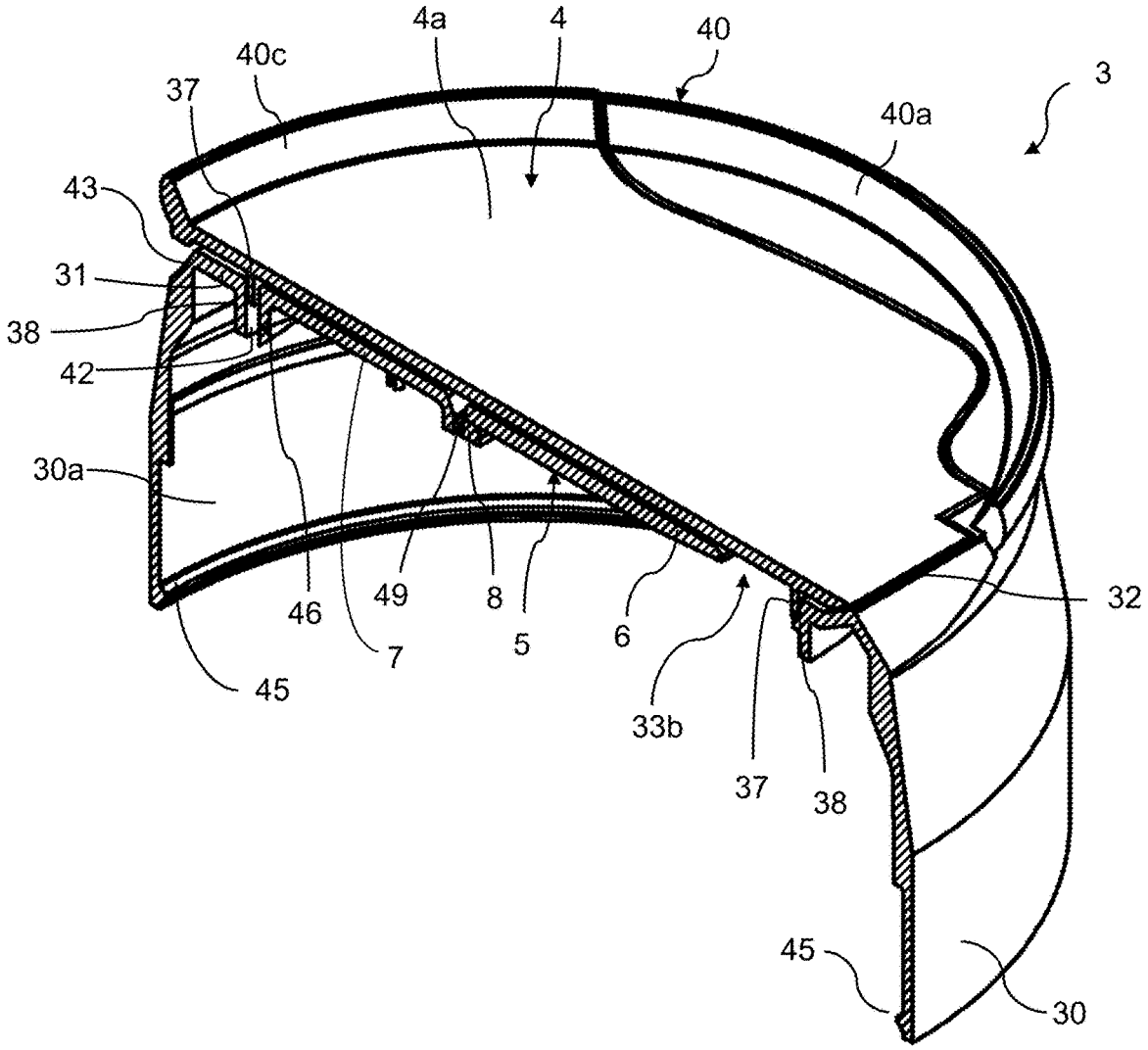
FIG. 5 is a perspective view of a section through the cap of the can shown in FIGS. 1 and 2.
Figure 6:
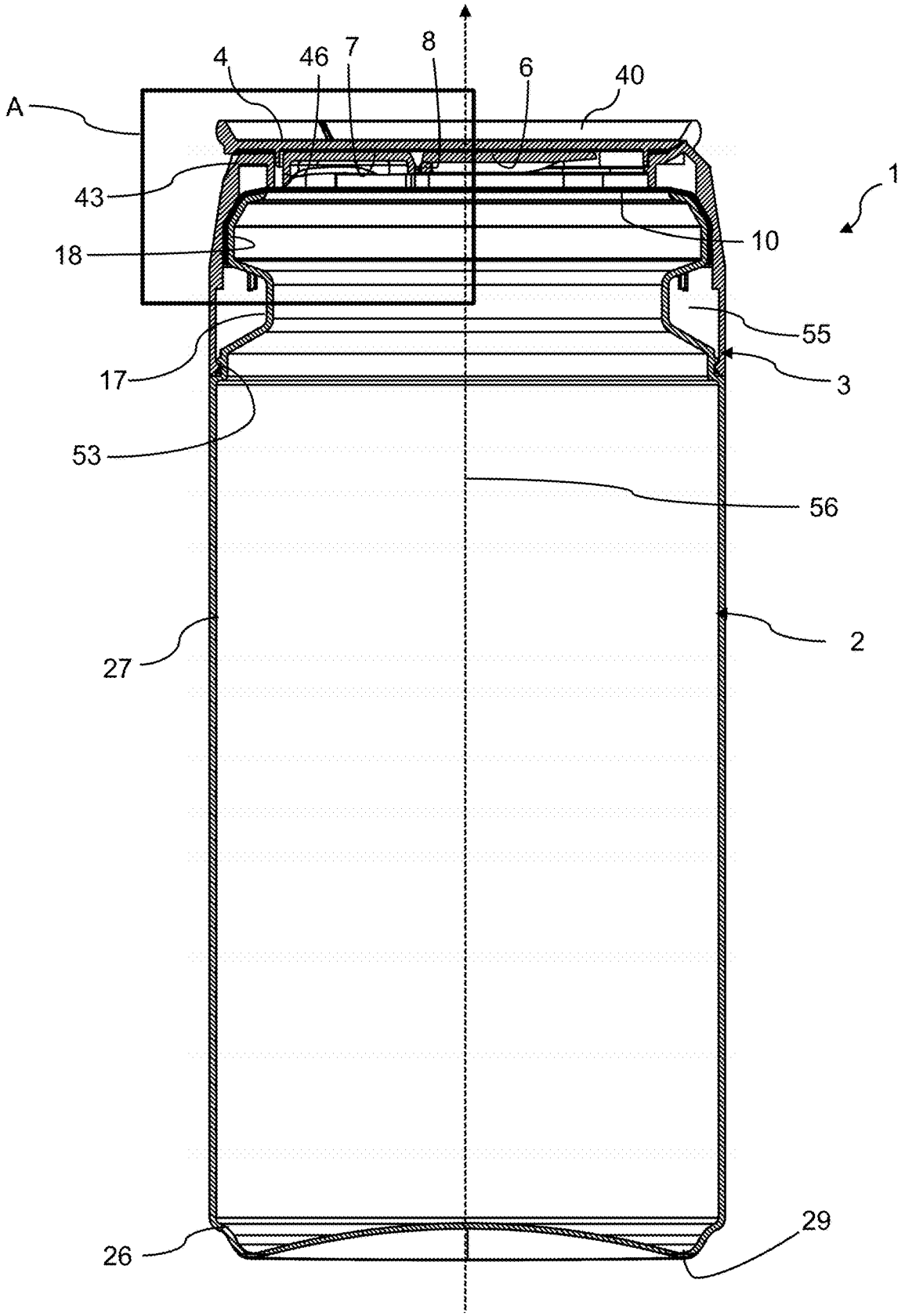
FIG. 6 is a longitudinal section view of the can of FIG. 1.
Figure 7:
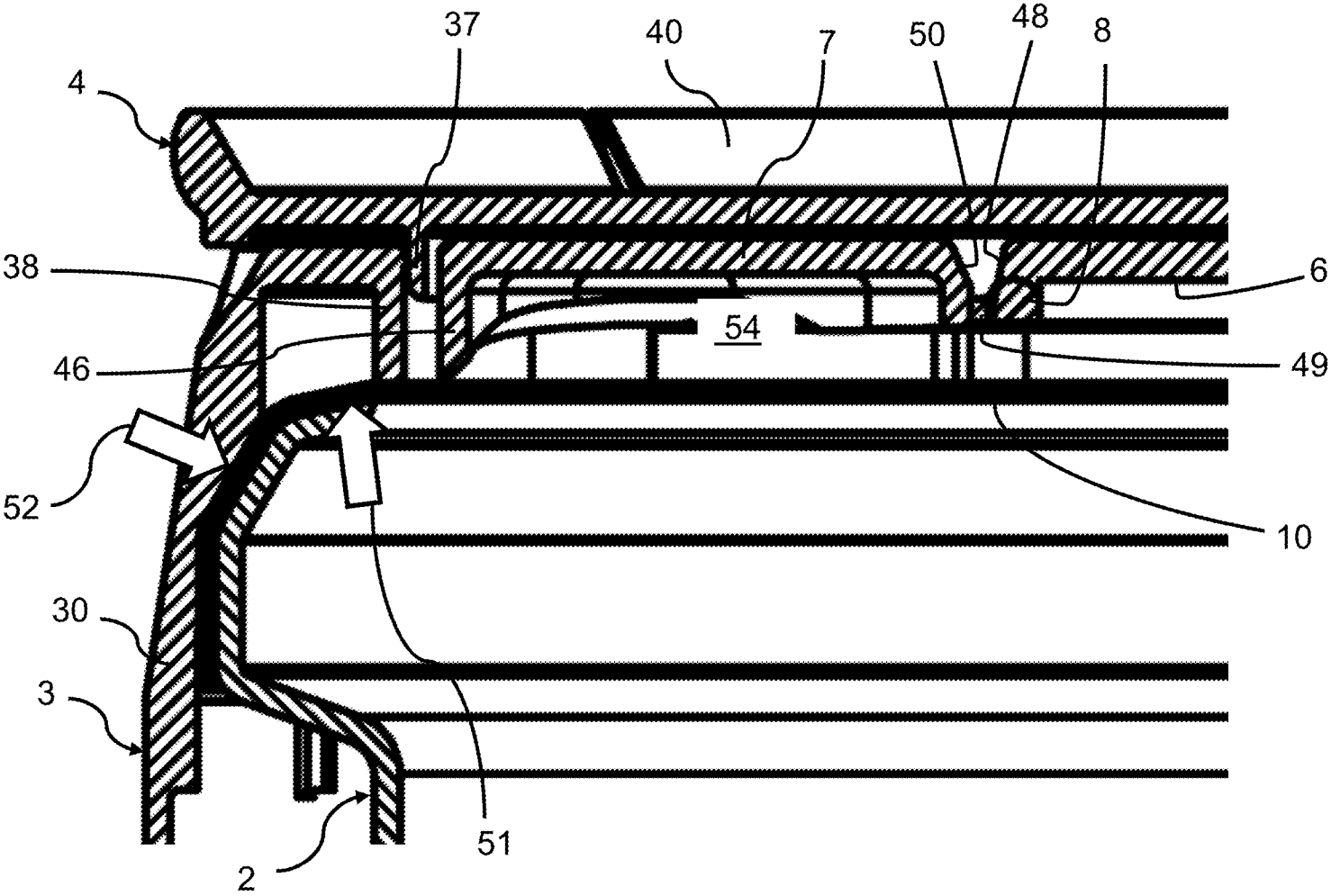
FIG. 7 is a detail view of FIG. 6, showing an enlargement of the contents of rectangle A of FIG. 6.

The outline of the projection 37 corresponds to the shape of the opening and/or closure zone 9 on the top wall 31 of the cap 3. When the lid 4 is in the closed position, as shown in FIGS. 5 to 7, the edge 37 is in contact with the wall 38 that delimits the closure zone 9, in such a manner as to close off the openings 33*a* and 33*b*. The closure zone 9 exhibits the same shape as the outline of the edge 37. When the lid 4 is closed, sealing is formed by the made-to-measure snug fitting between the outline of the edge 37 and the wall 38 that delimits the opening zone 9. The wall 38 is in the form of a depression or indentation relative to the horizontal level 35 of the top wall 31 of the cap 3. In particular, the support 34 of the piercing device 5 is lower than the surface of the level 35 of the top wall 31. In this way, the support 34 does not prevent the lid 4 from closing by the edge 37 being inserted into the closure zone 9.

In an embodiment, the surface area of the entire bottom face 4*b* of the lid 4 represents the area covered by the lid 4 as closed. Preferably, the lid 4 features and/or covers an area of at least 2.0 $cm^2$ or more, preferably 2.5 $cm^2$ or more, more preferably 3.0 $cm^2$ or more, and even more preferably 3.5 $cm^2$ or more. In a preferred embodiment, the area covered by the lid 4 is at least 4.0 $cm^2$ or more. This area of the lid includes the above-defined surface area of the zone 47, and more generally the surface area that goes beyond the drinking opening 14 and that surrounds said drinking opening. The relatively large area of the bottom face 4*b* of the lid 4 constitutes an advantage for hygiene, as described elsewhere in this specification.

In a preferred embodiment, the cap comprises a lid or some other form of protection that covers said piercing device and/or that covers at least an area of surface that is designed to constitute a drinking opening once the can is opened.

As can be seen in FIG. 4, a slot 42 is provided between the piercing plate 7 and the closure wall 38 at the opening 33*a*. The lever tab 6 and the closure wall 38 are separated from each other by an even wider slot at the opening 33*b*. To sum up, the elements of the piercing device 5 are confined in the opening zone 9 in such a manner as to enable the lid 4 to be lowered and the sealed contact to ensue between the complementary geometrical shapes of the closure wall 38 and of the outline of the edge 37 of the lid 4.

In an embodiment, the can 1 comprises a receptacle 3 with an opening 19, a cap 3, and a closure 10 disposed over the opening 19, said cap including a piercing device 5 disposed in a lid closure zone 9, delimited by a first delimitation wall 38, and said cap includes a pivotally mounted lid 4 comprising a second delimitation wall 37, said first and second delimitation walls comprising complementary shapes, said pivotally mounted lid being disposed in such a manner as to be able to close said closure zone by said complementary shapes fitting together in interfitting manner.

In the embodiment shown in the figures, the lid 4 exhibits a non-circular outline, including curved shapes designed to improve the pleasing appearance of the cap 3 as a whole. To accommodate the lid 4 properly in the closed position, the top wall 31 comprises a raised horizontal level 36, subdivided into two separate levels 36*a* and 36*b*, delimited by side walls 39*a* and 39*b* that match the side portions 41*a* and 41*b* of the curved outline of the lid 4. In this way, when the lid is in the closed position (FIGS. 5 to 7), the top face 4*a* of the lid 4 is situated on the same horizontal level as the raised level 36 of the top wall 31.

When the lid 4 is in the closed position, the entire top face of the cap 3 is thus generally flat and horizontal, but it is also provided with a rim 40 that is essentially continuous at its periphery. The rim 40 is preferably in the shape of a circle or of a portion (arc) of a circle, preferably extending through an angle of at least 180°, and preferably of at least 270°. The rim 40 is formed by the side rim portions 40*a* and 40*b* disposed on the top wall 31, and by the front rim portion 40*c* disposed at the periphery and at the front of the lid 3, on its top face, as can be seen more clearly in FIGS. 1 and 5. In the embodiment shown, the rim 40 is almost circular, having the shape of an arc extending through a reflex angle. The circle formed by the rim 40 is interrupted only over the back portion of the cap 3, where the lid 4 is connected via the hinge 32, as can be seen more clearly in FIG. 5. The person skilled in the art can understand that the rim 40 could be completely circular, or could also be absent, without going beyond the concept of the invention.

In a variant of the embodiment shown in the figures, the lid 4 is disk-shaped, with, in particular, an outline that is substantially circular. In this variant, the raised horizontal levels 36*a* and 36*b* are absent, and the top face of the lid 4 extends over the entire top of the cap 3, and/or forms the entire top face of the cap 3 when the lid is in the closed position.

The projecting rim 40 contributes to the stability of the stacked cans. More particularly, the rim 40 makes it possible to place a can of the same type and comprising a bottom provided with complementary structures, e.g. a peripheral annular setback 26 and an edge 29 as described with reference to FIG. 2. A can stacked and/or placed on the cap 3 of another can below it is stabilized by the rim 40 of the can below it, while its own rim 40 can surround the complementary shape of a can above it. In addition, the circular or almost circular projecting rim 40 contributes to giving the can 1 of the invention the appearance of a can, since metal cans generally comprise a rim formed by folded over metal layers.

A notch 43 is situated at the top and at the front in the skirt 30 of the cap 3. The notch 43 facilitates opening of the lid by enabling the consumer to press upwards from below on the lid 4 using a finger. The consumer who takes hold of the can in the embodiment shown by holding it normally in the palm of the hand, can conveniently push up the lid by pressing the end of the thumb against the lid at the notch 43. The lid 4 is thus disposed or arranged in such a manner as to be opened with one hand only.

Easy opening of the lid 4 as described above does not preclude providing tamper-proofing or tamper-evidencing means that have to be opened or destroyed on opening the can for the first time. Such tamper-proofing or tamper-evidencing may constitute additional closure means, serving to confirm to the consumer that the can has not yet been opened. It may be impossible for such tamper-proofing or tamper-evidencing to be opened with one hand only. Tamper-proofing or tamper-evidencing, e.g. in the form of a tear-off film of plastic (tear-off strip or tamper-proofing), may also be used to cover the outside surfaces of the can 1 that come into contact with the consumer's mouth during drinking. The tamper-proofing or tamper-evidencing thus increases the hygiene of the can and reduces the risk of the consumer being contaminated while drinking. This applies in particular insofar as the outside surfaces are not yet covered by the lid 4, as described with reference to the contact zone 47.

In FIG. 5, the cap 3 is shown with the lid 4 in the closed position. The way in which the sealing lip 37 and the wall 38 of the closure zone 9 are put in place by means of their complementary shapes can be seen. It can be understood that the wall 38 is extended downwards in the form of an annular band or sleeve that connects to the bottom surface of the top wall 31. In particular the slot 42 can be observed, in which the portion at the front of the sealing wall 37 of the lid 4 is placed.

When the lid 4 is in the closed position, it also rests on the top face of the piercing device 5. Preferably, before the can is opened for the first time, the lid 4 is disposed horizontally, above the piercing device 5, which is also disposed horizontally. For example, the lid 4 rests on the plate 7 and the lever tab 6. In the embodiment shown, the lid 4 also rests on the top wall 31 of the cap.

In the embodiment shown, the lid 4 rests on the top face 35 of the top wall 31, said top face forming a horizontal support level for the lid 4.

Preferably, the top surfaces of the lever tab 6 and the piercing plate 5 are substantially or entirely horizontal and face the bottom surface 4*b* of the lid 4 when the lid 4 is in the closed position.

Figure 8:
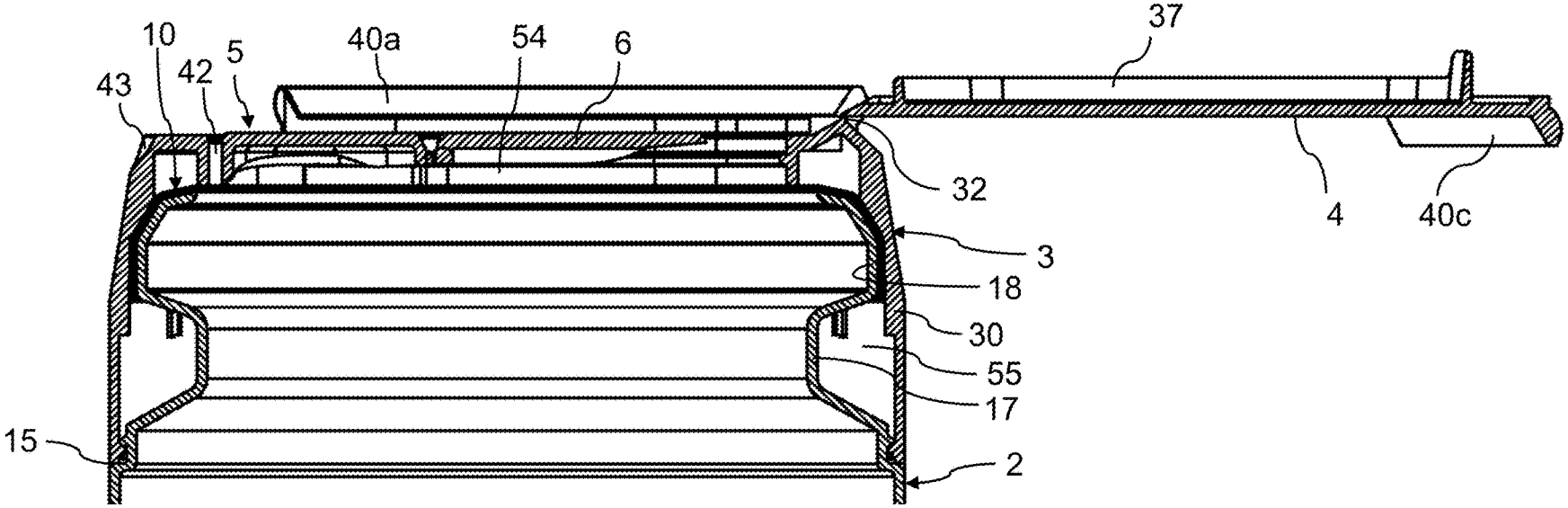
FIG. 8 is a longitudinal section view of the top portion of the can of FIG. 1, with the lid being in the open position.

In FIG. 5, the annular projection 45, disposed on the inside face 30 of the side wall 30 can be seen. This annular projection 45 is adapted to be pushed into the groove 22 in the top portion 21 of the receptacle 2 (FIG. 3), as can be seen in FIGS. 8 and 9, when the cap 3 is placed on the receptacle 2. Placing the projection 45 in the groove 22 constitutes means for attaching the cap 3 to the receptacle by snap-fastening, also making it possible to provide at least partial sealing between the cap 3 and the receptacle 2.

In an embodiment of the invention, the cap may be attached to the receptacle by snap-fastening means, bayonet fittings, or screw-fastening including complementary inside and outside threads respectively in the cap and on the receptacle, for example. Connections that prevent movement in an axial direction relative to the receptacle are preferred, such as bayonet fittings and snap-fastening connections. Preferably, the cap is also fastened by gluing or heat-sealing/welding to the receptacle as described below.

In FIG. 5, the protuberance 46 can be seen, formed on a radially outer portion of the piercing plate 7. This protuberance 46 terminates at a point that points downwards. The piercing protuberance 46 is disposed at the place where the drinking opening is situated, once the can is completely open.

FIG. 6 shows the entire can 1 of the invention, as completely closed, before it is used for the first time. Only the foodstuff contained in the can has been omitted. In this figure, the closure 10 can be seen. The closure represents the closure of the can 1, and in particular of the receptacle 2. The closure is placed over the opening 19 (FIG. 3) and is fastened to the bonding (heat-sealing or welding) edge 44 of the receptacle 10. The closure is pierced when the can is opened for the first time.

The dashed arrow 56 indicates the general axis of the can 1. This axis is vertical when the can is stood on a horizontal surface and it corresponds to the upward longitudinal direction of the can, towards the arrow.

In an embodiment, the can 1 of the invention comprises a receptacle 2 with an opening 19, a cap 3 fastened to the receptacle 2, and a closure 10 disposed over the opening 19 in such a manner as to close said opening 19 in hermetically sealed manner. Preferably, the closure 10 includes a thin metal layer and a heat-seal lacquer. Preferably, the closure is placed by bonding over the receptacle 2 in such a manner as to close the receptacle 2 and thus the can 1 in hermetically sealed manner.

The closure may be produced with materials specific to packaging, e.g. to sterile packaging. Closures of this type are commercially available. Preferably, the closure is produced from materials that enable it to be pierced, e.g. by the piercing device 5 made of plastic, as described in the context of the present invention. Preferably, the closure makes it possible both for the opening 19 to be closed in hermetically sealed manner and also for piercing to take place using a pointed piece of plastic pressed by pressure that can conveniently be generated by a user manipulating the piercing device 5.

The closure is generally in the form of a film, and preferably a film having a plurality of layers, including, for example, a metal layer or foil, e.g. aluminum or tin foil, and one or more layers of plastic. One or more layers of heat-seal lacquer are generally disposed on the closure over defined zones of one of the two surfaces of the closure or of both of said surfaces of the closure. The closure is generally a composite material, e.g. of a laminated composite including different materials in the form of foils or films.

The closure 10 is generally substantially circular. The closure may also be made up of or include one or more films of plastic and/or one or more heat-seal lacquers. In an embodiment, the closure is a film including superposed layers, e.g. layers of different materials, e.g. a metal film and a plastics film. The layers of heat-seal lacquer may be disposed on the underside (corresponding to the bottom face of the closure in its position on the assembled and filled can) and/or on the topside (corresponding to the top surface) of the closure, preferably over annular surfaces on the closure, in such a manner as to enable the closure to be bonded to the receptacle 2 and/or for the cap 3 to be bonded to the closure, respectively.

In a preferred embodiment, the closure includes heat-seal lacquer on both of its opposite surfaces. The lacquer on the respective sides defines or constitutes respective positions for sealing the closure. The layers of lacquer are preferably disposed over annular surfaces of the closure. Preferably, a first ring of lacquer is disposed on the underside of the closure and a second ring of lacquer is disposed on the topside of the closure, which ring is designed to be in contact with the cap 3 of the assembled and filled can. Preferably, the first and second rings of lacquer are not, or not entirely superposed on either side of the closure, so that the sealing using the lacquer of the first ring can be performed separately and at another place form the sealing using the lacquer of the second ring. For example, the ring of lacquer on the underside of the closure is situated at least partially inside the ring of lacquer on the topside.

The FIG. 6 view in longitudinal section through the can includes the only axis of symmetry of the cap 3, thereby cutting through the piercing device 5 longitudinally. The piercing plate 7 together with its piercing member 46, the shaft 8 and the lever tab 6, can therefore be seen. The lid 4 is in the closed position, resting on the piercing device 5.

In an embodiment in which the receptacle 2 is not filled via the opening 19, but rather, for example, via another opening, the closure to be pierced (or piercable) by the piercing device 5 may be formed differently from what is described above. The invention also covers a closure formed, for example, by rupture lines or rupture points present in the top wall of the receptacle 2, e.g., when the opening 19 is absent and the receptacle is closed at the position of the opening 19 by said wall. In this embodiment, the receptacle may be provided with a filling opening in the portion of the receptacle that is shown at the bottom in the figures and/or that is situated at the bottom of the receptacle.

FIG. 7 shows an enlargement of the detail contained in the rectangle A of FIG. 6. This enlargement makes it possible to see more clearly the film hinge 49 that connects the piercing plate 7 to the shaft 8 of the piercing device 5.

In the embodiment shown, the shaft 8 is formed by two pins 8*a* and 8*b* that connect the piercing device 5 on either side of the top wall 31, in particular to the support 34 of the piercing device. The pins 8*a* and 8*b* connect the lever tab 6 at its front end (in FIG. 4) to the support 34 of the piercing device 5. The pins 8*a* and 8*b* are situated close to the connection between the lever tab 6 and the piercing plate 7, at an end of the tab 6 that is opposite from the end designed to be taken hold of by the user.

Since the pins 8*a* and 8*b* are thin branches, they enable the lever tab 6 to pivot by means of their elasticity/resilience and/or flexibility. Said pivoting is thus the result of thin/weak regions at chosen places (the pins 8*a* and 8*b*) that are suitable for bending when a traction force is applied to the lever tab 6 by a user wishing to open the can. In a preferred embodiment, the lever tab 6 is disposed in such a manner that it can be lifted and/or pivoted upwards in order to generate the opening of the can, preferably by the striker 7 moving downwards and/or pivoting downwards.

By means of the film hinge 49, the piercing plate 7 can pivot at least partially about the shaft 8. Conversely, in the embodiment shown, the lever tab 6 of the piercing device 5 is rigidly connected to the shaft 8, and it can even be said that the shaft 8 (the pins 8*a* and 8*b*) is part of the lever tab 6. The lever tab cannot therefore pivot relative to the shaft 8, but rather it can pivot about a horizontal axis that corresponds to the axis of the shaft 8 and/or of the pins 8*a* and 8*b*, when the lever tab is lifted by a user. The lever tab 6 comprises a lever edge 48 (see also FIG. 4). The lever edge 48 is preferably in the form of a straight-line edge comprising a plane, flat surface in the form of a strip. In the embodiment shown, the lever edge 48 is parallel to the axis of the shaft 8. Preferably, the lever edge 48 stands up above the shaft 8 and faces the piercing plate 7. The piercing plate comprises a bearing surface 50 extending parallel to the lever edge 48 and facing said lever edge. The bearing surface is preferably also flat and in the form of a strip.

As can be understood by the person skilled in the art, when a user lifts the lever tab 6 by holding it in its position in which it is designed to be taken hold of by a user and, by pivoting the tab 6 upwards, the lever edge 48 comes to bear against the bearing surface 50. The force exerted by a user on the lever tab 6 is thus transmitted to the piercing plate by pivoting the lever tab, thereby causing the piercing plate 7 to pivot in the same direction. Pivoting the piercing plate 7 counterclockwise (in leftward rotation) causes the closure 10 to be pushed in by the piercing member 46.

In a preferred embodiment, the lever tab 6 is disposed in such a manner that it can be taken hold of and lifted by a user, the tab 6 being lifted causing the striker 7 to be lowered and thus the closure 10 to be torn.

Preferably, the lever tab 6 is pivoted by the user until it is in a vertical position (not shown) or close to a vertical position. The piercing plate is thus also forced into a vertical position, as shown in FIG. 9, and the closure 10 is pushed in so that the drinking opening 14 is generated by the piercing plate 7 being displaced and by the closure 10 rupturing. FIG. 9 shows the lever tab 6 in the horizontal position, folded back after the closure 10 has been pierced.

It should be noted that, once in the vertical position (FIG. 9), the piercing plate 7 is retained in that position by stop structures (not shown). By means of the film hinge 49, the lever tab 6 can be pivoted in the reverse direction (clockwise) until it is, once again, situated in the horizontal position, as shown in FIG. 8. The person skilled in the art can understand that, while the can 1 is being opened by piercing the closure, the lever tab 6 and the plate 7 are constrained to move in rotation (leftwards), whereas, once the closure has been pierced, the lever tab 6 is pivoted in the reverse direction, without entraining the plate 7 with it. After piercing, the hinge 49 thus makes it possible for the tab 6 and the plate 7 to move in rotation relative to each other.

Arrow 51 in FIG. 7 indicates the position of a bond between the closure 10 and the receptacle 2. It should be noted that the closure 10 closes the receptacle hermetically and in fully sealed manner, so as to guarantee sterility for the contents of the can 1. The bond 51 may be formed by heat-sealing (thermal welding), laser welding, induction welding, or circular friction welding ("spin-bonding"), for example. An example of spin-bonding is given in U.S. Pat. No. 4,840,289.

On its underside, and before it is positioned on the receptacle after the receptacle has been filled, the closure comprises a ring of heat-seal lacquer (not shown). When the closure is placed on the receptacle 2, the heat-seal lacquer on the closure is positioned in such a manner as to be in contact with the bonding edge 44 (FIG. 3). The bonding edge is situated on the top end of the outside surface of the ring 18, in the position indicated by arrow 51. Once the closure is correctly positioned on the opening 19 of the receptacle 2, the bonding is performed in order to close the receptacle 2 of the can hermetically. The closure is preferably fastened by heat-sealing, i.e. by thermal welding. For example, a hot iron ring is pressed lightly against the outside face of the closure in order to cause the heat-seal lacquer on the closure to fuse with the plastics material of the receptacle 2.

It should be added that the bond 51 is circular and extends over the entire periphery of the bonding edge 44, in particular over an annular loop over the substantially horizontal outside surface of the ring 18, the position of which as seen in longitudinal section is indicated by arrow 51.

In a preferred embodiment, the can 1 of the invention comprises a bond for attaching the cap 3 to the receptacle 2. This bond is preferably a second bond 52. In the embodiment shown in the figures, the bond 52 of the cap 3 is situated between an inside surface of the skirt 30 of the cap 3 and an outside surface of the closure placed on the ring 18. In another embodiment, the bond of the cap 3 is not situated on the closure, but rather directly between the plastics material of the cap and the plastics material of the receptacle 2, e.g. at or close to the snap-fastening connection 53 (FIGS. 6 and 9). In another embodiment, the closure 10 does not extend to the position 52 and the cap 3 is in direct contact with the receptacle 2 at the position 52, e.g. in direct contact with the outside surface of the ring 18.

Like the bond 51 (the first bond) between the closure 10 and the receptacle 2, the second bond 52 may be made by laser, induction, or spin bonding, for example. Bonding by applying heat is less advantageous. Giving a heat source access to the position of the bonding is not easy to imagine, since the bonding is bonding that takes place inside the can, after the cap 3 has been placed on the receptacle 2. In a preferred embodiment, the bond 52 is situated on an inside portion of the cap 3. Spin-bonding, as disclosed in Document U.S. Pat. No. 4,840,289, is a possibility for forming the bond 52. In a preferred embodiment, the bond between the cap 3 and the closure 10, or between the cap and the receptacle 2, is formed by induction welding.

The bond 52 of the cap does not necessarily need to be as hermetic and sealed (leaktight) as the first bond 51. The bond 52 of the cap serves firstly to attach the cap in fixed or rigid manner to the receptacle. In a preferred embodiment, the bond prevents the cap 3 from moving in rotation relative to the receptacle 2. The snap-fastening connection 53 is not a rigid connection and a user could easily detach the cap 3 from the receptacle 2 or turn the cap 3 relative to the receptacle 2. The bond 52 of the cap 3 increases the connection between the receptacle and the cap 3 and prevents the cap and the receptacle from moving in rotation relative to each other.

In addition, the bond 52 contributes to the sealing between the cap 3 and the receptacle 2. The person skilled in the art can understand, in particular, that once the can 1 is open, as shown in FIG. 9, the beverage contained in the can 1 can pass through the hole 14 created in the closure and can find itself between the cap and the receptacle. This also applies when the lid 4 is closed. It should be noted that an empty space 54 is provided between the outside surface of the closure 10 and the inside surface of the cap 3, and thus below the piercing device 5 and the top wall 31 (FIGS. 2 and 4).

In an embodiment, the can 1 includes a cap 3 comprising a piercing device 5 including an actuation lever 6 that can be activated by a consumer in order to pierce said closure 10 so as to generate a drinking opening 14, said cap 3 comprising a pivotally mounted lid 4, disposed in such a manner as to close over said drinking opening 14 and thus as to re-close the can 1.

When, after piercing the closure 10, a user re-closes the lid 4, the foodstuff contained in the can 1 can flow into the space 54, e.g. when the can 1 is on its side or when it tips. In an embodiment of the can 1 of the invention, provision is made for the cap 3 to be connected to the receptacle 2 in a substantially sealed manner. The sealing between the cap 3 and the receptacle 2 may however be of lesser degree than the sealing between the closure 10 and the receptacle. The sealing of the cap 3 does not need to guarantee sterility for the contents of the can, unlike what applies for the sealing generated by the bond of the seal 51.

The annular space 55 (FIG. 9) is provided between the receptacle 2 and the cap 3 at the narrowing in the top portion 21 of the receptacle, in particular at the neck 17. If the contact between the cap 3 and the ring 18 is no longer fully sealed, e.g. in the position 52 (FIG. 7), the liquid foodstuff is able to flow into the space 55. From this space, the liquid might flow through the snap-fastening connection 53 and could leak out at the transition 15 between the receptacle and the cap 3 and thus run down the outside surface of the receptacle 2, in particular over the outside wall 27 of the cylindrical body 20. To avoid such leakage of liquid foodstuff, the snap-fastening connection 53 contributes to sealing between the cap 3 and the receptacle 2.

Generally, the can 1 comprises a sleeve (not shown) over its outside surface. The sleeve generally contains the graphic design, the decoration, and any other communications to the consumer. For example, the sleeve may include information concerning the foodstuff contained in the can 1. Naturally, the invention also covers all of the other embodiments of decorations and information for the packaging, such as, for example, a decoration applied by In-Mold Labeling (IML), the use of a label, e.g. glued to the can, direct printing on the can 1, and/or cardboard surrounding the can, for example.

In a preferred embodiment, the can 1 comprises an outer sleeve (not shown). Preferably, the sleeve covers the circular line 15 that indicates the transition between the cap 3 and the receptacle 2 on the outside (FIG. 1). Preferably, the can 1 comprises a sleeve that masks or hides the fact that the can is comprises two parts that are separable as visible (at least partially) from the outside, namely the receptacle 2 and the cap 3. Since the receptacle 2 and the cap 3 comprise outside dimensions (diameter d1) that are identical at the connection between them, the plastics film sleeve makes it possible to mask effectively the separation 15 between the cap 3 and the receptacle as can be seen from the outside. The sleeve thus contributes to increasing the effect of the can 1 looking like a conventional can, since metal cans are typically in the form of a uniform and/or continuous part, at least over their outside side surface. In a preferred embodiment, the sleeve covers (at least partially) the outside surface of the cylindrical wall 27 of the receptacle 2 and, at least partially, the outside surface of the skirt 30 of the cap 3, while also covering the outside line 15 of connection between the cap 3 and the receptacle 2. The sleeve can thus contribute to the sealing between the cap 3 and the receptacle 3 by covering the line 15, thereby preventing or reducing the risk of the foodstuff leaking out via the connection 15 after the closure 10 has been pierced.

Preferably, the sleeve is not used to attach the cap to the receptacle. Preferably, the purpose of the sleeve is not to prevent the cap from moving in a longitudinal (axial) direction of the can.

The sleeve may be produced with a shrinkable plastics film or of a stretch plastics film. In case of a shrinkable film, it is placed and then shrunk, e.g. by heat treatment, about the substantially cylindrical outside surface of the can 1. The plastic sleeve also contributes to the sealing between the cap 3 and the receptacle 2. The stretch sleeve is stretched and placed over the can. On the can, the stretched plastic tightens to form the sleeve.

The can 1 of the invention thus contains one or more elements or structures that can contribute to the sealing between the cap 3 and the receptacle 2, in order to avoid leakage of the liquid via the transition between the cap and the receptacle (line 15 in FIG. 1).

As mentioned, the lid 4 makes it possible to re-close the can 1 once it has been opened. Preferably, the lid 4 also makes it possible to achieve a re-closure that is essentially or at least partially sealed. The person skilled in the art can understand that the sealing between the closure 10 and the receptacle 2, created by the bond 51 is preferably absolute or complete, whereas the sealing produced by the lid 4 is partial or relative. If a can having had its closure 10 pierced and having its lid 4 re-closed is lying on its side, on the cylindrical outside surface 27, the lid preferably makes it possible for the can to be sealed for a certain amount of time, e.g. in the range 10 minutes to 48 hours, and preferably from 1 hour to 24 hours. Conversely, it is not necessary and no provision is made for the lid 4 to enable the can 1 to be closed hermitically as described with reference to the closure 10. The sealing between the lid 4 and the cap 3 and the sealing between the cap 3 and receptacle 2 is preferably sealing to a lesser degree than the sealing between the closure 10 and the receptacle, which sealing preferably makes it possible to keep the contents of the can 1 sterile, in accordance with a preferred aspect of the invention.

FIG. 8 shows the upper portion of the can 1 with the lid 4 in the open position, pivoted backwards about the film hinge 32. The piercing device 5 is in its rest or base position, before it is used to open the can for the first time. The closure 10 is intact and hermetically closes the volume of the receptacle 2 of the can.

As can be seen in FIGS. 5 and 8, the entire piercing device 5, in particular comprising the striker 7 and the lever tab 6, features top surfaces that are substantially horizontal. When the lid 4 is closed, as shown in FIG. 5, it is also in the horizontal position, disposed in parallel to the top surface of the piercing device. The top surfaces of the lever tab 6 and of the striker 7 are essentially in the same horizontal plane, this plane being parallel to the plane of the lid 4 in the closed position. The entire piercing device 5, or at least the visible outside portion, features a flat, horizontal configuration, as applies with metal cans. In the closed position, the lid 4 may be placed over the top surfaces of the piercing device.

The lever tab 6, in particular its top surface, is plane and/or flat overall. This surface preferably extends substantially horizontally, and preferably essentially in the same plane as a substantially horizontal top wall of the cap 3. The striker 7 is also plane and/or flat, ignoring the piercing structure 46 designed to pierce the closure 10, which structure is disposed on the bottom surface of the striker and extends substantially vertically. The striker 7 and the lever tab 6 respectively have the flat general shape of a disk and the flat general shape of a tab. The piercing device 5 thus looks like the opening mechanism of a conventional metal can. For this reason, the user will instinctively understand the opening mechanism, in spite of the fact that plastics cans including such opening systems did not exist hitherto. In particular, the lever tab 6 is arranged in such a manner that it can be lifted with the tip of a finger so as to cause the striker to be lowered, and thus the can to be opened. The flat configuration of the piercing device and/or the fact that it is arranged in a horizontal plane, thereby minimizing its horizontal extent, make(s) it possible to save space and facilitates stacking the cans.

One or more parts that may be part of the can 1 of the invention, chosen in particular from among the receptacle 2, the cap 3, the closure 10, and/or the sleeve (if a sleeve is present) may comprise or be made of a "barrier packaging material", e.g. a composite material comprising one or more layers of different materials. Preferably, the material is chosen in such a manner as to form a barrier against, for example, one or more or all of the following: light, air (or a gas or oxygen in particular), and moisture or humidity. As specified in this description, the receptacle 2, the cap 3, and/or the sleeve are preferably made of plastic, but they may comprise layers of plastic or of some other material, in order to increase the barrier qualities of the packaging. A barrier material is preferably a composite material that comprises a plurality of different materials in order to combine the qualities of each of the materials, including the mechanical qualities, for example.

The present invention also relates to methods concerning manufacturing and/or obtaining the can of the invention, filling and/or assembling the can, for example.

A method of the invention preferably includes a step of taking a receptacle 2 that comprises a lower portion 20 and/or a portion including a volume designed to be filled with a foodstuff. Preferably, said receptacle comprises a neck 17 and a ring 18, enabling the receptacle 2 to be taken hold of, e.g. by robotized arms and/or for automated filling. The receptacle 2 is preferably produced from plastic. Preferably, the receptacle is produced to contain multiple layers as described above.

In an embodiment, the method of the invention aims to obtain a can containing a sterile liquid foodstuff. In which case, the method includes a plurality of sterilization steps, making it possible to guarantee sterility. In another embodiment, the method does not aim to obtain a sterile liquid foodstuff. In which case, the sterilization step for sterilizing the liquid foodstuff may be omitted, e.g. replaced by a pasteurization step. Preferably, the receptacle 2 and the closure 10 are sterilized, e.g. as described in the present description, even if the liquid foodstuff is pasteurized rather than being sterilized, for example.

The method of the invention preferably includes a step of sterilizing the inside volume of the receptacle 2 and/or the inside surfaces of the receptacle. Preferably, the empty receptacle is sterilized in this step. Sterilizing the receptacle 2 may be performed by any possible means, e.g. by heat treatment, by chemical treatment, by ionization (e.g. by exposure to gamma rays or a beam of accelerated electrons), or by a combination comprising two or more of these treatments. In a preferred embodiment, the sterilization of the receptacle is performed by chemical treatment, and preferably by exposure to a disinfectant gas, such as, for example, ethylene oxide or a peroxide. The person skilled in the art can understand that sterilization preferably takes place in apparatus that is closed in sealed manner, thereby making it possible to generate a desired atmosphere, depending on the sterilization method used. The closure 10 may be sterilized by the same types of sterilization as those used for sterilizing the receptacle 2.

It should be noted that it is preferably the inside of the receptacle that is sterilized. When sterilization is by exposure to a disinfectant gas, the disinfectant gas is injected into the receptacle. Preferably, the inside space of the receptacle is arranged in such a manner as to enable effective and quick sterilization with a disinfectant gas. This preferably requires absence of remote cavities or nooks in the inside space of the receptacle and into which gas would find it difficult to penetrate during the step of sterilizing the receptacle.

The method of the invention preferably includes a step of sterilizing the liquid foodstuff with which the receptacle is to be filled. In a preferred embodiment, the foodstuff is a beverage, e.g. a milk-based beverage. Preferably, the foodstuff is sterilized by heat treatment, e.g. by Ultra High Temperature (UHT) treatment. UHT treatment per se is commonly used as a food-grade technique for sterilizing milk and dairy products in general. UHT treatment preferably involves exposure to a temperature greater than 100° C., e.g. from 130° C. to 160° C. for from 1 second to 15 seconds, and preferably at least 135° C. for an appropriate period of more than 2 seconds, e.g. from 140° C. to 150° C. for from 2 seconds to 5 seconds.

Preferably, pasteurization is not considered as a sterilization method for sterilizing a foodstuff in accordance with the present invention.

The method of the invention preferably includes a step of filling the (empty) receptacle 2 with the foodstuff. If the method aims to obtain a sterile liquid foodstuff, the food is sterilized before it is filled. Preferably, the filling takes place under aseptic packaging conditions. In an embodiment, a sealed filling apparatus is used. The inside of the apparatus is preferably provided with sterile air.

The method of the invention preferably comprises a step of hermetically sealing or closing the receptacle 2 filled with the foodstuff. In an embodiment, sealing and/or closing the receptacle 2 comprises putting a closure 10 in place. Preferably, the closure is disposed so that the opening 19 in the receptacle is fully covered over, and the closure is bonded to the receptacle, preferably to a ring 18 that defines the opening 19 in the receptacle 2. To this end, the closure preferably comprises a portion made of plastic or a lacquer suitable for being bonded, i.e. heat-sealed or welded, to the plastics material of the receptacle, in particular the ring 18 of the receptacle 2. More details concerning the material from which the closure is produced and how it is sealed to the filled receptacle are disclosed above. Methods enabling the closure to be bonded to the receptacle are also described and are part of a preferred embodiment of the method of the invention. Bonding the closure by heat treatment is the preferred method.

Preferably, the closure is also sterilized, e.g. by chemical treatment, prior to sealing the receptacle. Preferably, the method of the invention includes two or three sterilization steps: (1) sterilizing the receptacle, preferably by chemical treatment; (2) sterilizing the closure, preferably by chemical treatment; and, optionally, (3) pasteurizing or sterilizing the liquid foodstuff, preferably by heat treatment. Preferably, the three sterilization steps, as well as the filling and the sealing of the closure to the receptacle are performed in suitable apparatus. Preferably, the steps (1)-(3), and the sealing of the closure are performed in the same apparatus. Preferably, this apparatus is adapted to aseptic packaging.

In an embodiment, the method of the invention includes the step of taking a plastics receptacle 2 that is filled with a liquid foodstuff and that comprises an opening 19 that is hermetically closed by a closure 10. In an embodiment, this step includes the following steps or sub-steps:

- providing an empty receptacle 2 that is made of plastic, that comprises a cylindrical portion 20, and that comprises an opening 19;
- sterilizing the inside of the receptacle 2;
- providing a closure 10 and sterilizing said closure 10;
- pasteurizing and/or sterilizing a liquid foodstuff;
- filling the receptacle 2 with the pasteurized and/or sterilized foodstuff; and
- sealing the opening 19 of the filled receptacle 2 by bonding the closure 10.

The person skilled in the art can understood that, during and after sterilization of the empty receptacle 2, said empty receptacle is preferably maintained in an aseptic atmosphere, e.g. it is exposed to a well-defined atmosphere (sterile air, predefined pressure) that prevents the receptacle from coming into contact with germs. The aseptic atmosphere is preferably maintained at least until the receptacle is sealed by the closure 10. Once sealed, the receptacle can be taken out of the aseptic atmosphere. In an embodiment, the method of the invention includes aseptic packaging. Preferably, the method of the invention, as from sterilizing of the empty receptacle, including filling the empty receptacle and sealing it, and at least until the closure is bonded, takes place inside a suitable apparatus that makes it possible to guarantee that the recipient remains sterile after it has been sterilized. The sterilization and/or filling apparatus is preferably adapted to aseptic packaging.

In the embodiment in which the liquid foodstuff is not sterile, the method of the invention includes the step of taking a plastics receptacle 2 that is filled with a liquid foodstuff and that comprises an opening 19 that is hermetically closed by a closure 10. In an embodiment, this step includes the following steps or sub-steps:

- providing an empty receptacle 2 that is made of plastic, and that comprises a cylindrical portion 20 and an upper portion 21 provided with an opening 19;
- providing a closure 10;
- providing a liquid foodstuff;

filling the receptacle 2 with the liquid foodstuff; and sealing the opening 19 of the filled receptacle 2 by bonding the closure 10.

Preferably, the inside of the receptacle 2 is sterilized before filling, as described in the embodiment of the invention in which the liquid foodstuff is sterile. Preferably, the inside of the receptacle 10 is also sterilized before filling, as described in the embodiment of the invention in which the liquid foodstuff is sterile.

The method of obtaining a liquid foodstuff that is not necessarily sterile preferably includes the step of pasteurizing the liquid foodstuff before the receptacle 2 is filled with it.

It should be added that, regardless of whether the foodstuff is sterile or not, the filling step may take place via the opening 19 in the receptacle 2 as shown in FIG. 3, or alternatively via any other opening that may be provided for that purpose. For example, the receptacle 2 may be provided with an opening at the bottom of the receptacle, enabling it to be filled from below. Such an alternative opening may be sealed, e.g. by applying a closure that is not designed to be opened by the consumer for drinking the foodstuff.

The method of the invention preferably includes a step of putting the cap 3 in place in order to form the can 1 of the invention, containing a foodstuff that is sterile or non-sterile, e.g. pasteurized. In an embodiment of the method, the receptacle 2 comprises a cylindrical body 20 and the cap 3 comprises a cylindrical side wall 30 having the same diameter as said body 2, and the assembly of the cap 3 and of the receptacle 2 exhibits the appearance of a preferably cylindrical can.

In a preferred embodiment, the cap 3 is connected to the upper portion of the receptacle 2 via connection means equipped with interacting complementary structural or mechanical portions, e.g. snap-fastening means or bayonet fittings. A screw-fastening connection of the cap 3 to the upper portion of the receptacle is also possible. In a preferred embodiment, the cap is connected to the receptacle by a snap-fastening connection, preventing the cap from being moved in an axial direction along the axis of the can.

In an embodiment, the cap 3 is also fastened to the sealed receptacle 2 by bonding (heat-sealing or welding) and/or by gluing. Preferably, a bonding material, e.g. a heat-seal lacquer, is disposed on the upper portion 21 of the receptacle or on the topside of the closure 10 of the sealed receptacle. The cap 3 is put in place on the sealed receptacle and the bonding is performed. Since the bonding location is generally situated inside the cap 3 (arrow 52 of FIG. 7), the bonding method is preferably chosen from laser welding, induction welding, and spin-bonding, for example.

In a preferred embodiment, said step of attaching the cap includes the sub-steps of placing the cap on the receptacle by snap-fastening it thereto, and of bonding the cap placed on the receptacle to said receptacle in order to prevent it from moving in rotation relative thereto.

The present invention also proposes a solution making it possible to avoid the risk of the closure 10 being pierced when the cap 3 is placed on the filled and sealed receptacle. In certain state-of-the-art solutions, it is proposed to connect a cap to a receptacle by screw-fastening. Screw-fastening may be considered as disadvantageous because the cap is brought increasingly close to the closure as the cap is being screwed onto the receptacle. It is then necessary to take particular measures to avoid the striker or some other portion of the cap piercing the closure at this stage of assembly of the can. It is also possible that a user or a member of staff of a retail outlet might turn the cap in order to tighten it or to re-fasten it onto the receptacle if it has become loose. By providing a snap-fastening connection between the cap and the receptacle and by preventing the cap from moving in rotation by bonding it, the present invention avoids those problems.

In a preferred embodiment, the closure 10 contains a heat-seal lacquer on its topside face (the face of the closure in FIGS. 6-9 that faces upwards towards the cap 3). Preferably, this lacquer is disposed over a portion of the surface of the closure, and preferably over an annular surface on the topside of the closure. The position of the heat-seal lacquer is indicated by arrow 52 in FIG. 7.

In an embodiment, the method of the invention includes a step of putting a sleeve in place around the can 1 as filled with the foodstuff. Preferably, the sleeve is situated in such a manner as to mask the presence of a separate cap 3, e.g. by covering the transition 15 between the receptacle 2 and the cap 3 on the outside surface of the can (FIG. 1).

A user or consumer who wishes to drink the foodstuff in the can 1, as shown in FIG. 1, firstly opens the lid 4. Any tamper-proofing or tamping-evidencing that is present must generally be removed, e.g. by being torn off, before the lid 4 can be opened.

When the lid is a pivotally mounted lid as in the embodiment shown, said lid 4 is pivoted backwards, as shown in FIGS. 4 and 8. The user then lifts the actuation lever 6. In the embodiment shown in the figures, a slot 33*b* is provided that enables the user to insert the tip of a finger behind an end of the lever 6. By pulling on the lever 6, the piercing plate or the striker 7, and in particular the piercing member 46 is pushed through the closure 10, in such a manner as to tear it, as shown in FIGS. 2 and 9. In these figures, the lever 6 has been folded back into its initial horizontal position, but the drinking opening 14 has already been generated. The user can then drink the liquid foodstuff contained in the can 1. Once the closure 10 has been pierced, the can 1 has been opened for the first time. The can may be re-closed and re-opened by means of the lid 4, but the closure 10 remains pierced and can no longer be re-closed, in the embodiment shown. The closure preferably constitutes single-use opening. The can being opened for the first time thus preferably differs from it being re-opened subsequently by the fact that the drinking opening 14 generated by piercing the closure 10 is generated once only the first time it is opened. Preferably, only re-closing by means of the lid 4 after the can has been opened for the first time closes the drinking opening 14.

As is clear from the above, the drinking opening 14 (FIGS. 2 and 9) is formed by lowering the striker 7 into the vertical position and pushing in the closure 10. Before the can is opened, the striker 7 occupies to a large extent the front recess 33*a* in the top wall 31 of the cap (FIGS. 4 and 5). The slot 42 of the recess 33*a* constitutes an opening in the top wall 31 with the piercing plant in the horizontal position (FIG. 8).

If the user does not wish to drink all of the liquid foodstuff at once, the user may re-close the can by re-closing the lid 4. When the lid 4 is a pivotally mounted lid, it suffices to pivot the lid 4 forwards so that the lid closes the closure zone 9 in order to close the can in sealed manner. The lid 4 brings at least partial sealing and/or temporary sealing to the re-closed can, in such a manner as to avoid unwanted leakage, e.g. if the re-closed can is tipped over accidentally. Similarly, the cap 3 is attached to the receptacle 2 in a manner sufficiently sealed to avoid leakage through the transition 15 (FIG. 1) between the cap and the receptacle.

In an embodiment, the cap 3 comprises a piercing device 5 suitable for piercing the closure 10, the cap 3 being adapted to exhibit a drinking or pouring opening 14 once the can 1 has been opened, which opening enables the liquid foodstuff to be drunk, the cap also comprising a lid 4 suitable for re-closing said drinking opening 14.

The person skilled in the art can understand that the present invention makes it possible to obtain a sterile liquid foodstuff in a can essentially made of plastic. Except for the closure 10 that may include a metal film, all of the components of the can may be made of plastics only. The invention is particularly advantageous in that it makes it possible to use existing filling installations for filling the can of the invention. Surprisingly, filling lines for filling plastics bottles under aseptic conditions may be used or adapted to filling a can exhibiting the appearance of a conventional can, characterized by the can shape and by an opening mechanism based on a lever tab 6. In addition, the invention offers a can that is re-closable, by means of the presence of the cap 3 comprising a pivotally mounted lid 4. Without wishing to be bound by theory, it could be considered that the concept of the present invention lies at least partially in the idea of transforming a bottle into a can by using a cap 3 as described in this description, e.g. instead of a screw cap as typically used for bottles. By means of its piercing device 5, the cap makes it possible to open the can 1 of the invention like a conventional can. The adaptations of the outside shapes of the bottle (the receptacle 2) and of the cap 3 make it possible to imitate the shape of a can.

As the person skilled in the art can understand on reading this description, the lid 4 and the closure are two separate closures for closing the can. The lid 4 may be considered as being a first closure, and the closure 10 as being a second closure. In an embodiment, the can 1 of the invention comprises a first closure 4 and a second closure 10, the first closure 4 being re-closable and the second closure 10 being designed to be opened once only. In particular, the closure 10 is a single-use closure: once the closure has been pierced, it can no longer be re-closed. Preferably, the seal 10 is disposed in such a manner as to be opened irreversibly when the can is opened. In other words, the closure 10 is not re-closable, unlike the lid 4: as soon as the closure is pierced, the sterility of the contents of the can 1 is no longer guaranteed, and it is recommended that the beverage be drunk rapidly and stored cold (in the range 0.5° C. to 5° C.).

The alternative embodiments shown in FIGS. 11 to 20 differ from the embodiment shown in FIGS. 1-10 mainly in way the cap of the can is implemented. It should be noted that several of the following figures show variations in the ways the lid and the piercing mechanism are implemented. Conversely, the receptacle 2, the seal 10 and the methods described in this description also apply to the embodiments shown in FIGS. 11-20.

Figure 10:
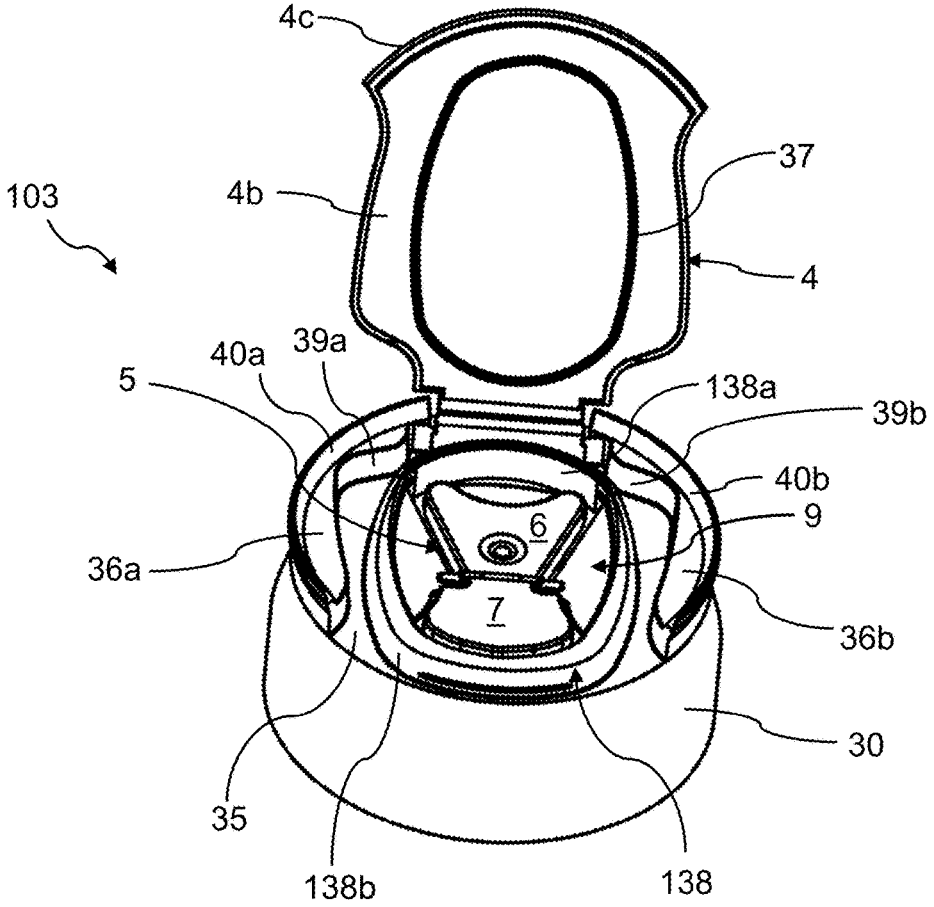
FIG. 10 is a front elevation view of a cap of a second embodiment of the invention.

FIG. 10 shows a cap 103 that differs from the cap 3 shown in FIGS. 1, and 3-9 by the presence of a protuberance or lip 138 that loops back on itself in a closed loop configuration and surrounds the closure zone 9 in which the piercing device 5 is placed as described above. The protuberance 138 contains an inside wall 138*a* having a shape adapted to receive the protuberance 37 on the bottom face of the lid 4. The inside wall 138*a* thus performs the same function as the wall 38 of the embodiment shown in FIGS. 4 and 5, for example. When the lid 4 is closed, the protuberance 37 fits into the protuberance 138 and comes into contact with the surface 138*a*, generating a certain degree of sealing and thus a closure between the lid 4 and the closure zone 9. Unlike a wall 38 being formed by the support 34 of the piercing device being situated on a lower level, the wall 138*a* is the result of the presence of the protuberance 138. The protuberance 138 projects above the horizontal level 35 covered by the lid, and thus comprises an outside surface 138*b* following the external outline of the protuberance 138. Towards the front, the protuberance 138 is part of the contact zone (zone 47 in FIG. 2) that is designed to be in contact with the lips and/or the mouth of a consumer while the beverage is being drunk. The protuberance 138 makes it possible to improve the sealing between the lid 4 and the opening zone 9, and to make the piercing device thicker in vertical extension. The walls 137 and 138 make it possible to reinforce the re-closure lid and to improve the re-closure snap-fastening.

Figure 11:
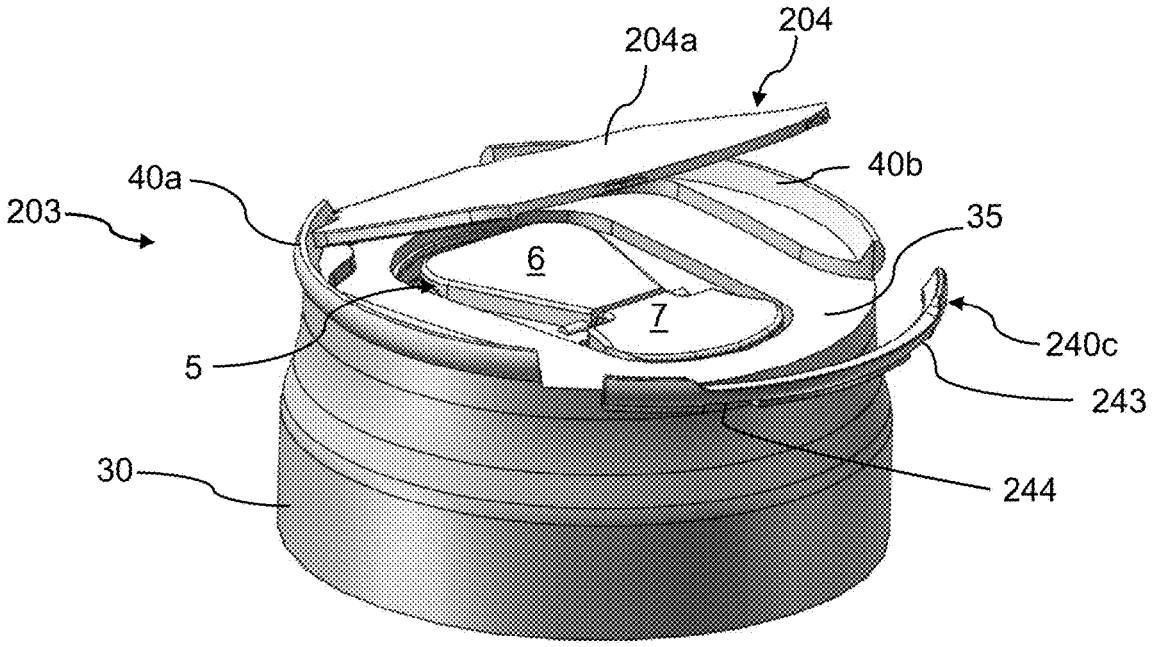
FIGS. 11 to 13 show a cap of a third embodiment of the invention.
Figure 12:
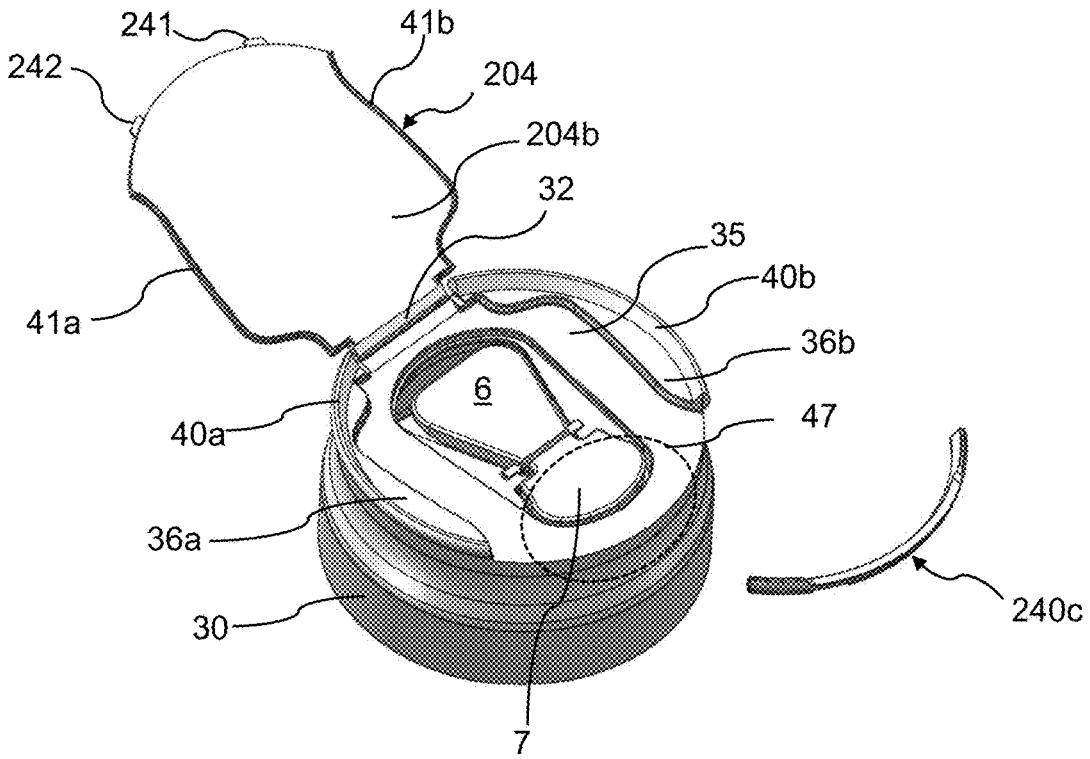
Figure 13:
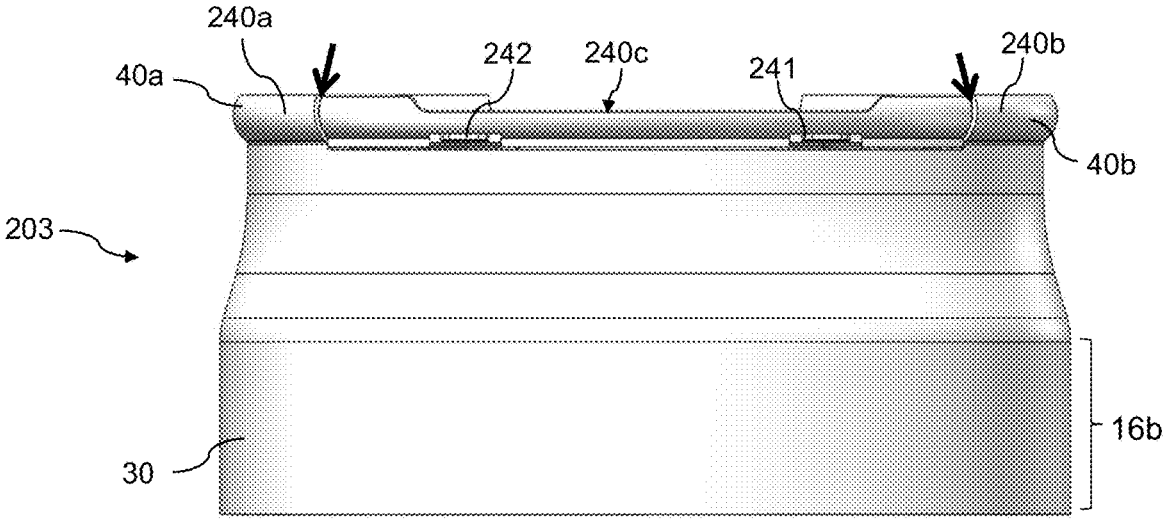

FIGS. 11, 12, and 13 show a cap 203 in which the lid 204 is not re-closable and/or in which the lid 204 is rendered safer by tamper-proofing or tamper-evidencing 240*c*.

In an embodiment, the cap 203 of the can of the invention comprises a lid 204 that is held in the closed position by a detachable structure 240*c* of the cap. The detachable structure is designed to be detached when the can is opened for the first time. The detachable structure 240*c* may constitute tamper-proofing or tamper-evidencing, indicating whether the can has already been opened, or, conversely whether it is still in its original state, e.g. its state on leaving the factory. The detachable structure is preferably discardable and not necessary for drinking the beverage.

In an embodiment, the detachable structure 240*c* is formed in one piece with the cap 203 during the injection molding of the cap. The cap 203 is molded with the lid 204 in the open position, and the lid 204 is closed by being pivoted forwards during assembly of the filled can. Alternatively, the detachable structure 240*c* may be attached to the cap 203 via bonding (heat-sealing or welding) or by gluing with adhesive.

In the closed can, the detachable structure 240*c* is connected to the cap 203 via one or more thin films or bridges that define rupture points and/or weaknesses.

In a preferred embodiment, the detachable structure 240*c* is arc-shaped in general shape. Preferably, the detachable structure 240*c* forms a portion of the rim 40 that surrounds at least a portion of the substantially circular top surface 36*a*, 36*b*, 204*a* of the closed can. Preferably, the detachable structure forms the rim towards the front of the top surface of the cap of the closed can. For example, the detachable structure is situated on or passes through the contact zone 47, which is designed to be in contact with the mouth of a consumer while the contents of the can are being drunk.

In an embodiment, two thin bridges (not shown) are situated respectively at the left and right ends of the arc-shaped detachable structure. Preferably, the rupture points, e.g. in the form of thin bridges or film connect the detachable structure 240 to the top rim 40 of the cap. The arcuate or circular rim 40 preferably comprises two free ends 240*a*, 240*b* towards the front. In FIG. 13, these ends 240*a*, 240*b* are situated on respective left and right sides of the contact zone 47 (FIG. 12). The (right and left) ends of the detachable structure 240*c* are preferably connected via rupture films or bridges to respective ones of the left and right ends 240*a*, 240*b* of the rim 40. The detachable structure is preferably disposed in such a manner as to be integrated into the rim 40, and to constitute a portion of said rim, in particular the front portion of the rim 4. The position of the bridges of the ruptures is indicated by the two arrows in FIG. 13.

Preferably, the detachable structure is disposed in such a manner as to be readily taken hold of in the hand. For example, the detachable structure may be readily taken hold of by the thumb and the index finger so as to be detached in order to open the can.

In an embodiment, and on its front end, the lid 204 comprises two retaining structures 241, 242, e.g. protuberances or projections. In FIGS. 11-13, these projections 241, 242 are in the form of small rectangles formed under the bottom surface 204*b* of the lid 204*a* and that project forwards. Preferably, the detachable structure 240*c* is adapted to retain the projections 241 and 242 in order to hold the lid in the closed position. In the embodiment shown in FIGS. 11-13, the detachable structure 240*c* is provided with two notches 243 and 244 adapted to receive respective ones of the projections 241, 242 when the detachable structure is not (yet) detached. These notches are formed on the bottom side of the detachable structure, thereby making it possible to accommodate the projections 241, 242 in or under the rim 40 formed towards the front of the cap by the detachable structure 240*c*.

Preferably, the lid 204 is not re-closable. Once the tamper-proofing or tamper-evidencing 240*c* has been detached, the lid 204 can no longer be fastened in the closed position. For this reason, the bottom surface 204*b* of the lid 204 shown in FIG. 12 is not provided with a projection 37 that forms a closed loop, e.g. an elliptical-shaped loop, in order to fit into the opening zone 9 of the cap.

In a preferred embodiment, the can of the invention comprises two openings. A first opening formed by the lid 204 that is locked in the closed position by tamper-proofing or tamper-evidencing 240*c* before the can is opened for the first time, and a second opening formed by the piercing device 5, adapted for piercing the closure 10 as described above. Preferably, both of these opening systems are not re-closable and are designed to be used once only. In an alternative embodiment, even though it is locked by tamper-proofing or tamper-evidencing 240*c*, the lid is also re-closable, as described for the can in FIG. 2 above.

The absence of a re-closable lid (FIGS. 11-13) may be useful when the beverage needs to be drunk rapidly after opening the closure 10, e.g. when the beverage is a beverage that is easily perishable. The presence of re-closable lid could encourage storing the open can, e.g. at ambient temperature. In addition, the absence of re-closable lid prevents the open can from being placed in a horizontal position after opening. As indicated with reference to the can of FIGS. 6-9, the sealing of the closure of the lid 4 is sealing to a lesser degree than the sealing obtained by the closure 10. Once the closure has been pierced, the liquid can escape from the can if it is kept in a horizontal position for long enough, even if the re-closable lid 4 is re-closed. These advantages also apply for the embodiment shown in FIGS. 14-17.

FIGS. 14 to 17 show an embodiment of the cap 303, in which the lid 4, 204 is replaced with a detachable lid 304. In this embodiment, a pivotally mounted lid 4, 204 is absent. The piercing mechanism 5 is as described above, but it is not covered with a re-closable lid.

In an embodiment, the cap 303 of the can comprises a piercing device 7 comprising a lever tab 6 and a striker 5, the tab 6 being disposed in such a manner as to be lifted and/or pivoted upwards to open the can, the cap also comprising a detachable and/or non-reclosable protection that covers at least a drinking opening 33*a* and/or an opening zone 9 of the can.

Figure 17:
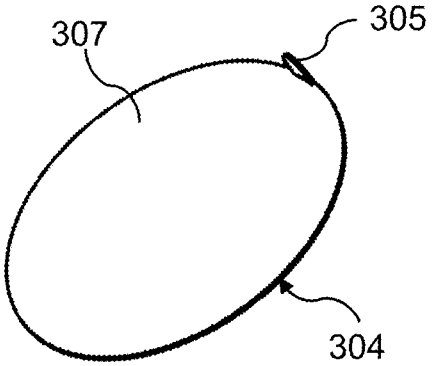
Figure 18:
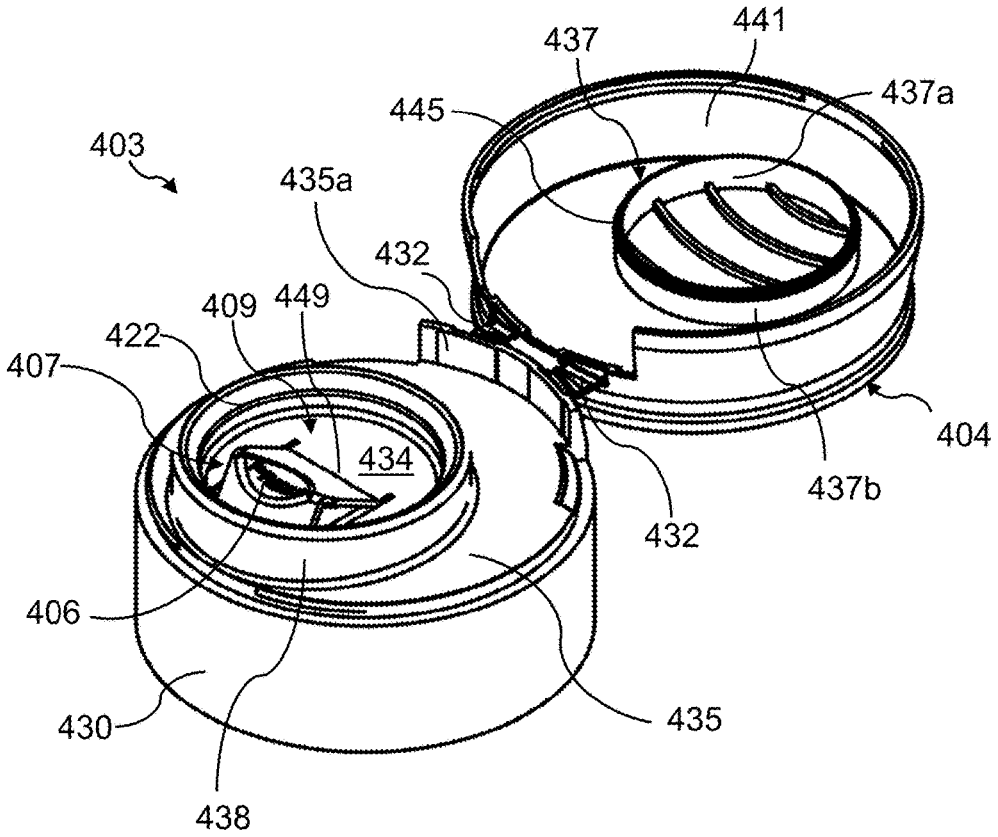
FIG. 18 is a perspective view of the cap of a fifth embodiment, in which the lid is pivoted backwards.
Figure 20:
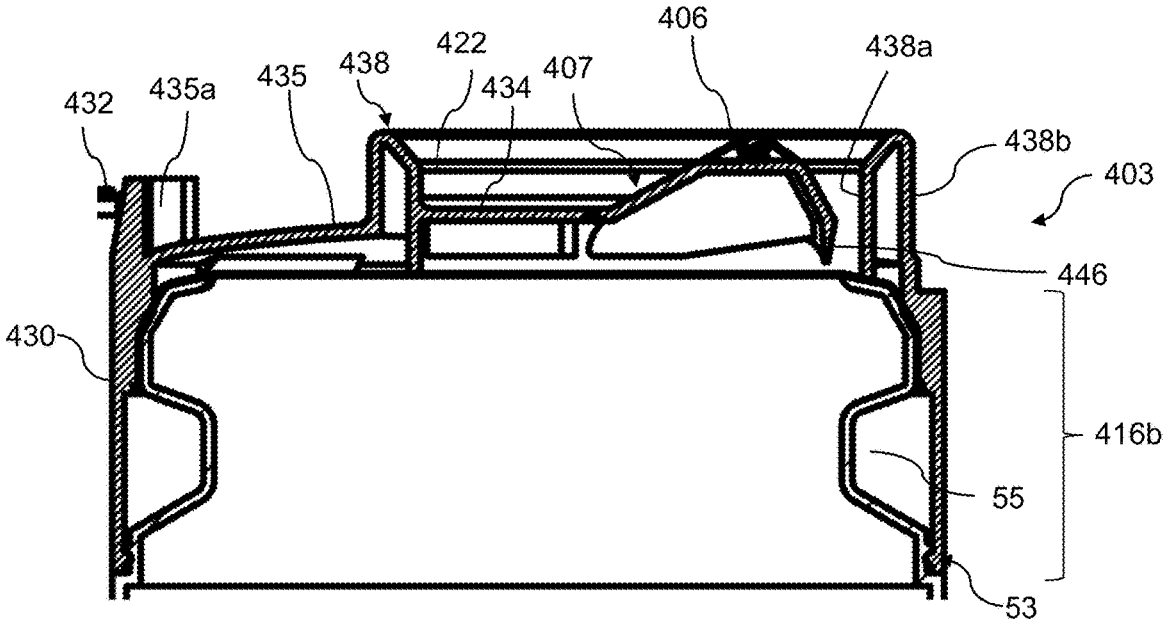
FIG. 20 is a detail view of FIG. 18, showing an enlargement of the cap of FIG. 18 without its lid.
Figure 19:
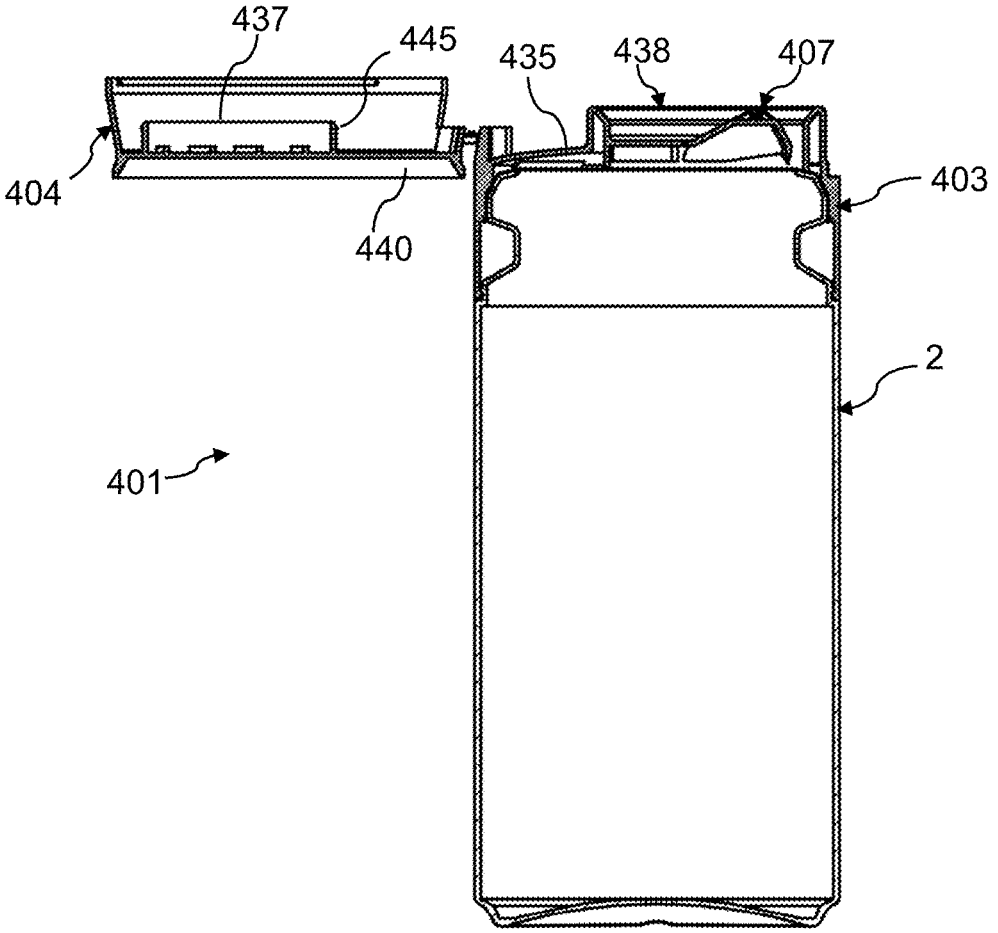
FIG. 19 is a longitudinal section view of the can comprising the cap shown in FIG. 18.

A can comprising the cap 303 preferably comprises a lid or a protection 304, shown in FIG. 17. The protection 304 is detachable and is designed to be discarded after the can 1 has been opened for the first time. The protection 304 covers at least the closure zone 9, with the piercing device 5. The opening zone 9 is preferably delimited by the wall 38. Preferably, the protection 204 covers the contact zone 47 at least partially. In a preferred embodiment, the protection covers the top surface 335 of the cap partially or fully. The top surface 335 is also the top surface of the assembly formed by the receptacle 2 and the cap 303, if the protection 304 is removed. If the protection 304 is present on the can as shown in FIG. 14, the protection constitutes the top surface of the can.

Figure 14:
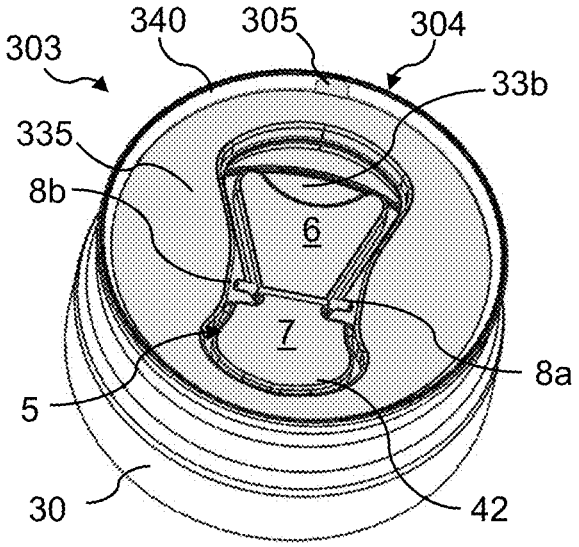
FIGS. 14 to 17 show a cap of a fourth embodiment of the invention, in which embodiment the pivotally mounted lid is replaced with a detachable cover, shown specifically in FIG. 17.
Figure 15:
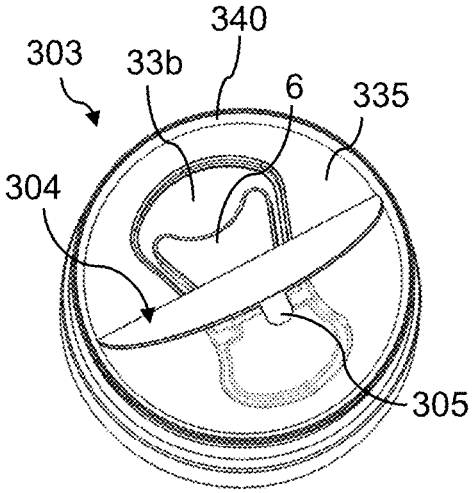
Figure 16:
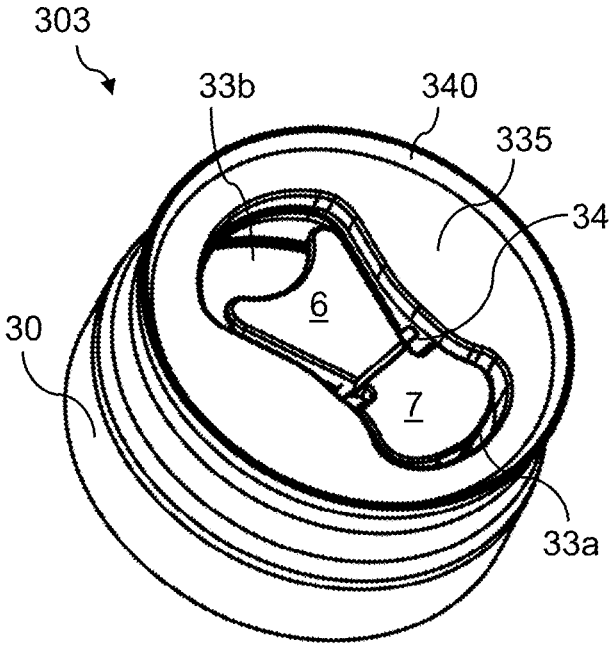

In the embodiment shown in FIGS. 14-16, the cap is provided with a circular and preferably continuous rim 340, forming the outline of the top surface 335. The rim 340 looks more like a rim formed by folding over metal layers in a metal can.

The piercing device 7 being disposed in a horizontal plane, as it is in metal cans, is advantageous compared with a piercing device on which the top surfaces are not flat. It is then possible to use a thin lid 304, in the form of a film or a disk, to protect the opening zone 9. A lid comprising a side wall (or skirt) is not necessary. The piercing device 7, flat over its top surface makes the can more compact along a vertical axis, facilitates applying a protection 304, and also facilitates stacking the cans.

In the embodiment shown in FIGS. 14-17, the protection 304 is a plastics film that is of circular shape, corresponding to the outline of the top surface 335 of the can. Preferably, the protection 304 is made of or contains flexible plastic.

Preferably, the protection is provided with a tab 305 that can be taken hold of by a consumer to enable it to be readily detached. For example, the tab 305 is in the form of a projection extending beyond the outline of the circle defined by the protection 304 and thus also extending beyond the top surface of the cap when the protection is placed on it.

In an embodiment, the protection 304 is transparent or translucent, as shown in FIG. 14, thereby enabling the consumer to see the piercing device 7 through the protection 304.

Preferably, the protection or the lid 304 is flexible and deformable. Preferably, it is "peelable" or "peel-off" and/or can be detached by peeling (FIG. 15).

Preferably, the lid 304 is attached to the top surface 335 to prevent unwanted detachment. In an embodiment, the lid 304 is bonded to the top surface 335 of the cap 303. For example, a heat-seal lacquer or some other bonding lacquer, present on the bottom surface of the lid 304, can be activated by heat and/or pressure being applied by using a soldering iron when the lid 304 is placed on the cap. Alternatively, the bottom surface of the protection 304 is provided with adhesive.

The bonding or the gluing between the flexible lid 304 and the top surface of the top wall 335 is preferably sufficiently weak to enable the protection to be detached easily when a user pulls the tab 305.

In an embodiment, the protection 304 has a thickness lying in the range 0.01 millimeters (mm) to 0.5 mm, preferably in the range 0.02 mm to 0.3 mm, and even more preferably in the range 0.03 mm to 0.1 mm.

FIGS. 18-21 show an embodiment of the invention based on a cap 403 provided with an alternative piercing device.

The piercing device comprises a striker 407 that is disposed to be pushed in directly by a user seeking to open the can 401. Unlike the piercing device used for the preceding embodiments, a lever tab, designed to be lifted and/or pivoted upwards and acting on the striker, is absent.

The striker 407 comprises a bearing surface 406, on which the tip of a finger may be readily placed so a then to push in the striker 407. An indication for the consumer may be provided on said bearing surface 406, so that said consumer understands how to open the can.

The striker 407 is hinged to a support structure 434 of the cap, e.g. by a film hinge. The support 434 preferably comprises a flat, horizontal surface, relative to which the striker 405 emerges, i.e. stands proud. The striker 407 does not exhibit a substantially flat configuration on a horizontal plane, unlike the piercing device of the preceding embodiments. By means of the profile that is raised relative to the support surface 434, a consumer can readily press on the striker 407 and push it in. Towards the back, the striker 407 is linked to the support by a film hinge 449. The film hinge, linking the striker 407 to the support towards the back makes it possible to pivot the striker forwards. Towards the front, the striker is retained in its position by rupture films or bridges (not shown) disposed laterally on either side of the striker. These rupture bridges fasten the front of the striker to the horizontal support surface 434. Their function is to prevent the striker from being pushed in in unwanted manner.

Before the can is opened for the first time, the striker 407 occupies the drinking opening in the support 434 and more generally in the intermediate surface 435 of the cap. The support, as well as the striker and the closure wall 438 are disposed on this intermediate surface, which is visible when the re-closable lid 404 of the cap is pivoted backwards.

The skirt 430 of the cap extends down from the intermediate surface 435. It co-operates therewith to form the cover of the upper portion 21 of the receptacle 2. The wall 435 is referred to as "intermediate" because of the horizontal and substantially circular wall 404*c* of the lid 403, the wall 404*c* forming the top surface 404*a* of the closed cap.

Figure 21:
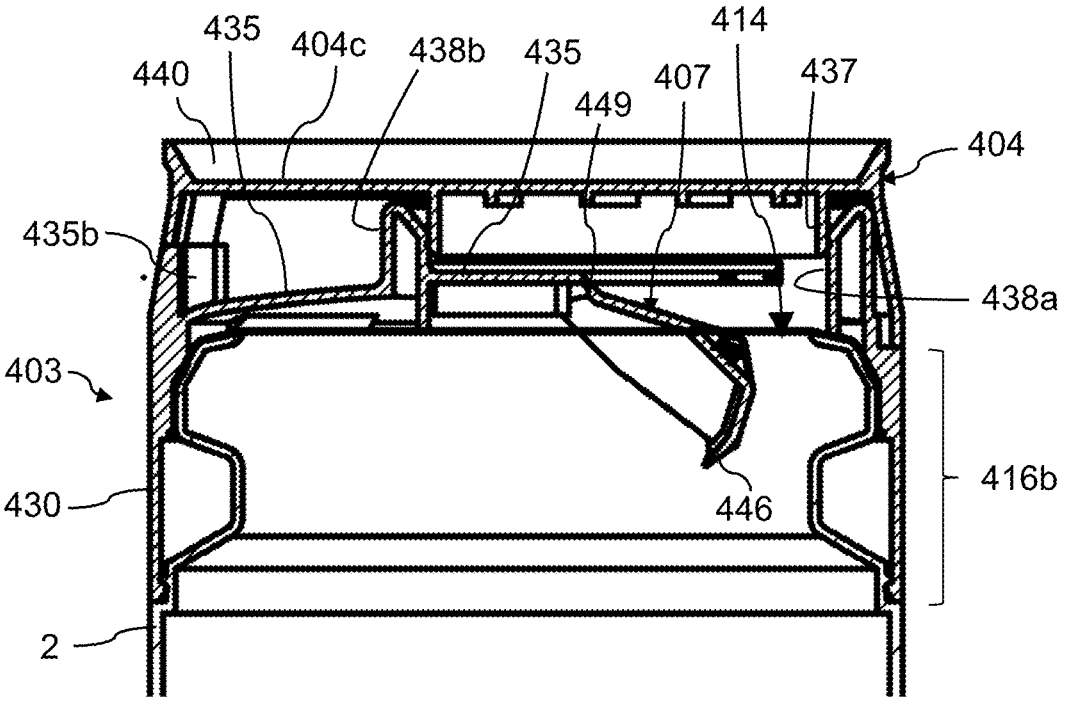
FIG. 21 is a longitudinal section view of the top portion of the can of FIG. 19, in which can the piercing device is pushed in and the lid is re-closed.

The striker 407 and the support 434 thereof are surrounded by a lower wall 438. The lower wall is substantially vertical and/or parallel to the general axis of the can. The wall 438 defines an opening zone 409 that is closed when the lid 404 is in the closed position (FIG. 21). An upper wall 437 is arranged on the bottom face 404*b* of the lid 404, in such a manner that, when the lid is pivoted forwards, one of the walls fits into the other. In the embodiment shown, the dimensions of the outside outline of the upper wall 437 are complementary to the dimensions of the inside surface of the lower wall 438, so as to enable the upper wall 437 to fit into the lower wall 438.

The outer and inner walls 438 and 437 have the form of protuberance or projections that form closed loops that are preferably circular or elliptical.

The lower wall 438 surrounds the opening zone 409 and in particular the drinking opening 414 that is generated in the cap and in the closure 10 once the striker is pushed in (FIG. 21).

To increase the degree of sealing obtained when the can is re-closed after it has been opened for the first time, and after the striker 407 has been activated, the complementary walls 438 and 437 are sufficiently high. When one of the walls is fitted into the other one, the two surfaces are in contact so as to generate the sealing. The higher the walls 437 and 438, the larger the area of contact and the more the degree of sealing is increased.

The inner wall 437 comprises an annular lateral projection 445 on its outside surface 437*b*, and the outer wall comprises a complementary annular groove 422 in its inside surface 438*a*. The projection 445 and the groove 422 have complementary shapes that co-operate to form a connection by snap-fastening. When the lid 404 is closed (or re-closed), the two walls 437, 438 fitting one into the other cause the projection to engage in the groove, thereby retaining the lid in the closed position and increasing the degree of sealing generated by the lid 404.

In the embodiment shown, the lid 404 is connected via a hinge 432 to the main portion and/or to the support 435 of the cap 403. For example, one or more butterfly hinges may be used.

In order for the pivoting of the lid 404 forwards into the closure position to make it possible for the lower and upper walls 437 and 438 to be fitted accurately one into the other, the hinges 432 may be disposed on a support 435*a* disposed on the rear portion of the intermediate wall 435. This support 435*a* makes it possible to position the lid 404 at an optimum height for achieving sealed re-closure. Preferably, the support 435*a* may also make it possible to attach butterfly hinges.

Since the striker 407 and the walls 438 and 437 extend to a relatively high extent in the axial direction (along a vertical axis), compared with the piecing device 5 of the preceding embodiments, the lid 404 also comprises a skirt or side wall 441 that is substantially annular or tubular. The side wall 441 of the lid is high enough to enable the raised striker 407 and the lower wall 438 to be covered. When the lid 404 is closed or re-closed (FIG. 21), the side wall 441 of the lid contributes to giving a uniform and continuous appearance to the outside shape. The top plate of the lid 404 comprises a top surface 404*a* that is horizontal (in the closed position) and that is substantially circular. A circular rim surrounds the top surface 404*a* of the lid and thus of the cap 403. The rim gives the can the appearance of the top end of a conventional metal can, as in the preceding embodiments.

The skirt 430 of the cap 403 preferably comprises a cylindrical portion 416*b*. Preferably, the lower portion 416*b* of the skirt 430 is cylindrical. The lower portion 416*b* is preferably arranged to constitute the outline and the uniform surface in contact with the lower portion of the receptacle 2, as described in the present description.

It should be added that the cap 403 shown in FIGS. 18-21 is preferably attached to the receptacle 2 in the same way as described for the preceding embodiments. The can 401 including the cap 403 (FIG. 19) comprises the same receptacle and the same closure as described above. In particular, in the example of the embodiment shown in FIGS. 1-9. The same method of obtaining a plastics can containing a liquid foodstuff may be applied to the can 401.

The can 1, 401 of the invention is generally designed to be discarded after the liquid foodstuff has been consumed. The can 1, 401 is disposable. Since the closure 10 has been pierced, provision is not made to re-use the can, and indeed such re-use may be inappropriate and/or impossible. The can of the invention is preferably designed for once-only use. Since the can is essentially made of plastic, it can be recycled. The person skilled in the art can understand that the can 1, 401 can be manufactured at low cost, using plastics materials that are commercially available and that do not require any particular characteristics. The can is easy to produce in large quantities and can be filled on existing production lines.

In an embodiment, the can of the invention encloses a volume of in the range 50 milliliters (ml) to 3 liters, and preferably in the range 80 ml to 2 liters, more preferably in the range 100 ml to 1.5 liters, and even more preferably in the range 200 ml to 1 liter.

In a preferred embodiment, the can contains in the range 150 ml to 500 ml, and preferably in the range 200 ml to 350 ml of a liquid foodstuff.

The can of the invention preferably exhibits the appearance of a typical can, such as the appearance of a metal can, for example. The can is generally cylindrical or comprises a cylindrical receptacle portion or segment. In an embodiment, the can of the invention comprises a cylindrical body 20 and the cap 3 comprises a cylindrical side wall 30 having the same diameter as said body 2, and the assembly comprising the cap 3 and of the receptacle 2 exhibits the appearance of a can.

In an embodiment, the height (h) of the can as a whole is greater than the width or the diameter (d, e.g. d1 in FIG. 3) of the cylindrical portion (d) (h>d) of the can. Preferably, the height is less than or equal to 8 times the width (h<8×d). Preferably, the dimensions of the can 1 are chosen such that h>d and h≤7×d. More preferably, h>1.5×d and h≤5×d, and even more preferably h≥2×d and h≤4.5×d. When the can or its receptacle is not essentially or is not entirely cylindrical, the term "width" refers to the greatest dimension of the can along a horizontal axis. In other words, if one or more external portions of the can (receptacle, cap) is/are of shaped profile, the maximum diameter is preferably used to determine the ratios between the height and the width of the can.

In a preferred embodiment, the external outline of the assembly comprising the cap 3, 103, 203, 303, 403 and the receptacle 2, seen in longitudinal section, is not convex and/or is not curved towards the outside. Preferably, external outline of the receptacle as seen in longitudinal section is not convex and/or is not curved towards the outside and/or the cross-sectional diameter of the receptacle or of the receptacle-and-cap assembly does not go through a maximum in the longitudinal (axial) direction of the can.

The person skilled in the art will encounter no particular difficulty in adapting the contents of the present disclosure to his or her own needs, and in implementing a can, without going beyond the ambit of the present invention. For example, it should be noted that adapting the present teaching to constructing another type of can will not pose any particular difficulty for the person skilled in the art.

The invention claimed is:

1. A can made essentially of plastic and containing a beverage, the can including a receptacle provided with an opening that is hermetically closed by a closure that is sealed to said receptacle by a bond situated between the closure and the receptacle, said closure being disposed in such a mariner as to be opened irreversibly when the can is opened for the first time, said can including a cap placed on an upper portion of the receptacle and including a piercing device adapted to be activated by a consumer to pierce the closure and thus to open the can, wherein said cap is secured to the receptacle by at least one further bond formed by heat-sealing or welding, said at least one further bond being situated between the cap and the closure.

2. The can according to claim 1, wherein said at least one further bond is situated on an inside portion of the cap.

3. The can according to claim 1, wherein said at least one further bond prevents the cap from rotating.

4. The can according to claim 1, wherein the cap is connected to the receptacle by way of a snap-fastening connection that prevents the cap from moving in a direction along an axis of the can.

5. The can according to claim 1, wherein said beverage in the can is sterile and has a shelf-life of at least 3 months.

6. The can according to claim 1, wherein said beverage is a milk-based beverage.

7. The can according to claim 1, wherein the receptacle comprises a lower portion and the cap comprises a lower portion, and wherein an external outline of the lower portions of said receptacle and said cap, when seen in longitudinal section, are not convex and/or are not curved towards the outside of said receptacle and said cap.

8. The can according to claim 1, wherein the receptacle comprises a lower portion that is not covered by the cap, and wherein said lower portion is essentially cylindrical or includes at least a cylindrical segment.

9. The can according to claim 1, wherein:

the receptacle comprises said upper portion and further comprises a lower portion, wherein said lower portion of the receptacle has an outside surface, said cap covers said upper portion of the receptacle and wherein the cap comprises a lower portion, said lower portion of the cap having an outside surface and extending to the lower portion of said receptacle, and wherein the lower portion of the cap and the lower portion of the receptacle exhibit an outline that, in profile, is continuous.

10. The can according to claim 1, wherein the receptacle comprises a lower portion comprising an essentially cylindrical portion or segment and the cap comprises a skirt including an essentially cylindrical lower portion in contact with said essentially cylindrical portion or segment of the lower portion of the receptacle, and wherein the cylindrical lower portion of the cap and the cylindrical portion or segment of the receptacle have the same diameter so that together they provide a uniform cylindrical outside appearance.

11. The can according to claim 1, wherein said cap comprises a lid or a protection covering said piercing device and/or covering at least a surface designed to constitute a drinking opening once the can has been opened.

12. The can according to claim 11, wherein the lid of the cap is re-closable.

13. The can according to claim 1, wherein said piercing device comprises a lever tab and a striker.

14. The can according to claim 13, wherein said lever tab is disposed in such a manner as to be suitable for being taken hold of and lifted by a user, lifting the lever tab causing the striker to be lowered and the closure to be torn.

15. The can according to claim 13, wherein a top surface of the lever tab is flat and extends substantially horizontally and in essentially the same plane as a substantially horizontal top wall of the cap.

16. The can according to claim 13, wherein the cap comprises a top wall that is substantially horizontal, said top wall being provided with a recess or with an opening enabling a user to take hold of the lever tab at one of its ends.

17. The can according to claim 1, including a first closure and a second closure, the first closure being re-closable and the second closure being designed to be opened once only.

18. The can according to claim 1, wherein said cap comprises a pivotally mounted lid and a closure zone, which is delimited by a first delimitation wall, wherein said piercing device is disposed in said closure zone, and wherein said pivotally mounted lid comprises a second delimitation wall, said first and second delimitation walls comprising complementary shapes, said pivotally mounted lid being disposed in such a manner as to be suitable for closing said closure zone by said complementary shapes fitting into each other.

19. The can according to claim 1, wherein:

the receptacle comprises said upper portion and further comprises a lower portion, wherein said lower portion of the receptacle has an outside surface, and said cap covers said upper portion of the receptacle and wherein the cap comprises a lower portion, said lower portion of the cap having an outside surface and extending to the lower portion of said receptacle, and wherein the outside surface of the lower portion of the receptacle contacts said outside surface of the lower portion of the cap.

20. A method of obtaining a can made essentially of plastic and containing a beverage according to claim 1, the method comprising the steps of:

providing an empty receptacle that is made of plastic, and that comprises a lower portion and an upper portion provided with an opening;

sterilizing the inside of the receptacle;

providing a closure and sterilizing said closure;

pasteurizing and/or sterilizing a beverage;

filling the receptacle with the pasteurized and/or sterilized beverage;

hermetically closing the opening of the filled receptacle by bonding, i.e. heat-sealing or welding, the closure to the receptacle, thereby providing a bond; and attaching a cap made of plastic to the hermetically closed receptacle by:

placing the cap on the receptacle, and, providing at least one further bond by heat-sealing or welding, wherein said further bond is provided between being the cap and the closure, and wherein said further bond prevents the cap from moving in rotation.

21. The method according to claim 20, wherein said step of placing the cap on the receptacle comprises snap-fastening the cap on the receptacle.

* * * * *